US009375046B2

(12) United States Patent
Meir

(10) Patent No.: US 9,375,046 B2
(45) Date of Patent: Jun. 28, 2016

(54) ARTICLE OF FOOTWEAR INCORPORATING A KNITTED COMPONENT WITH INLAID TENSILE ELEMENTS AND METHOD OF ASSEMBLY

(71) Applicant: NIKE, Inc., Beaverton, OR (US)

(72) Inventor: Adrian Meir, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 14/535,413

(22) Filed: Nov. 7, 2014

(65) Prior Publication Data

US 2016/0088893 A1 Mar. 31, 2016

Related U.S. Application Data

(60) Provisional application No. 62/057,264, filed on Sep. 30, 2014.

(51) Int. Cl.

| | |
|---|---|
| ***D04B 1/22*** | (2006.01) |
| ***A43B 1/04*** | (2006.01) |
| ***A43B 23/02*** | (2006.01) |

(52) U.S. Cl.

CPC ..... *A43B 1/04* (2013.01); *A43B 23/027* (2013.01); *A43B 23/0245* (2013.01); *D04B 1/22* (2013.01); *D04B 1/225* (2013.01)

(58) Field of Classification Search

CPC ..... D04B 1/22; D04B 1/225
USPC ..... 66/169 R, 170, 171, 177; 36/45, 47, 48
See application file for complete search history.

(56) References Cited

U.S. PATENT DOCUMENTS

| | | | |
|---|---|---|---|
| 601,192 | A | 3/1898 | Woodside |
| 1,215,198 | A | 2/1917 | Rothstein |
| 1,597,934 | A | 8/1926 | Stimpson |
| 1,888,172 | A | 11/1932 | Joha |
| 1,902,780 | A | 3/1933 | Holden et al. |

(Continued)

FOREIGN PATENT DOCUMENTS

| | | |
|---|---|---|
| DE | 870963 C | 3/1953 |
| DE | 1084173 | 6/1960 |

(Continued)

OTHER PUBLICATIONS

Declaration of Dr. Edward C. Frederick from the US Patent and Trademark Office Inter Partes Review of U.S. Pat. No. 7,347,011 (178 pp).

(Continued)

*Primary Examiner* — Danny Worrell
(74) *Attorney, Agent, or Firm* — Brinks Gilson & Lione

(57) ABSTRACT

Various articles may include a knitted component formed of multiple knitted component portions. The knitted component is formed of unitary knit construction and includes multiple tubular rib structures and multiple webbed areas. An article of footwear may include an upper incorporating a knitted component. The upper may be assembled through a wrapping process. The upper may comprise areas with tubular rib structures arranged in different orientations over the forefoot region, the midfoot region, the vamp region, and the heel region of the article of footwear. Some regions of the upper may have a greater number of tubular rib structures than other regions, and some tubular rib structures can include tensile elements.

20 Claims, 26 Drawing Sheets

(56) References Cited

U.S. PATENT DOCUMENTS

| | | | | |
|---|---|---|---|---|
| 1,910,251 | A | 5/1933 | Joha | |
| 2,001,293 | A | 5/1935 | Wilson | |
| 2,047,724 | A | 7/1936 | Zuckerman | |
| 2,147,197 | A | 2/1939 | Glidden | |
| 2,151,879 | A * | 3/1939 | Weber | 66/190 |
| 2,314,098 | A | 3/1943 | McDonald | |
| 2,330,199 | A | 9/1943 | Basch | |
| 2,343,390 | A | 3/1944 | Ushakoff | |
| 2,400,692 | A | 5/1946 | Herbert | |
| 2,440,393 | A | 4/1948 | Clark | |
| 2,569,764 | A | 10/1951 | Jonas | |
| 2,586,045 | A | 2/1952 | Hoza | |
| 2,608,078 | A | 8/1952 | Anderson | |
| 2,641,004 | A | 6/1953 | Whiting et al. | |
| 2,675,631 | A | 4/1954 | Doughty | |
| 2,994,322 | A | 8/1961 | Cullen et al. | |
| 3,307,379 | A * | 3/1967 | Adams et al. | 66/178 R |
| 3,583,081 | A | 6/1971 | Hayashi | |
| 3,694,940 | A | 10/1972 | Stohr | |
| 3,704,474 | A | 12/1972 | Winkler | |
| 3,766,566 | A | 10/1973 | Tadokoro | |
| 3,778,856 | A | 12/1973 | Christie et al. | |
| 3,952,427 | A | 4/1976 | Von den Benken et al. | |
| 3,972,086 | A | 8/1976 | Belli et al. | |
| 4,027,402 | A | 6/1977 | Liu et al. | |
| 4,031,586 | A | 6/1977 | Von den Benken et al. | |
| 4,211,806 | A | 7/1980 | Civardi et al. | |
| 4,232,458 | A | 11/1980 | Bartels | |
| 4,255,949 | A | 3/1981 | Thorneburg | |
| 4,258,480 | A | 3/1981 | Famolare, Jr. | |
| 4,317,292 | A | 3/1982 | Melton | |
| 4,373,361 | A | 2/1983 | Thorneburg | |
| 4,447,967 | A | 5/1984 | Zaino | |
| 4,465,448 | A | 8/1984 | Aldridge | |
| 4,607,439 | A | 8/1986 | Sogabe et al. | |
| 4,737,396 | A | 4/1988 | Kamat | |
| 4,750,339 | A | 6/1988 | Simpson et al. | |
| 4,756,098 | A | 7/1988 | Boggia | |
| 4,785,558 | A | 11/1988 | Shiomura | |
| 4,813,158 | A | 3/1989 | Brown | |
| 5,031,423 | A | 7/1991 | Ikenaga | |
| 5,095,720 | A | 3/1992 | Tibbals, Jr. | |
| 5,117,567 | A | 6/1992 | Berger | |
| 5,118,569 | A * | 6/1992 | Kuroda et al. | 428/367 |
| 5,152,025 | A | 10/1992 | Hirmas | |
| 5,192,601 | A | 3/1993 | Neisler | |
| 5,345,638 | A | 9/1994 | Nishida | |
| 5,353,524 | A | 10/1994 | Brier | |
| 5,356,701 | A * | 10/1994 | Wei et al. | 442/6 |
| 5,371,957 | A | 12/1994 | Gaudio | |
| 5,419,161 | A | 5/1995 | Bodenschatz et al. | |
| 5,461,884 | A | 10/1995 | McCartney et al. | |
| 5,511,323 | A | 4/1996 | Dahlgren | |
| 5,572,860 | A | 11/1996 | Mitsumoto et al. | |
| 5,575,090 | A | 11/1996 | Condini | |
| 5,623,840 | A | 4/1997 | Roell | |
| 5,729,918 | A | 3/1998 | Smets | |
| 5,735,145 | A | 4/1998 | Pernick | |
| 5,746,013 | A | 5/1998 | Fay, Sr. | |
| 5,765,296 | A | 6/1998 | Ludemann et al. | |
| 5,884,419 | A | 3/1999 | Davidowitz et al. | |
| 5,890,381 | A * | 4/1999 | Leeke et al. | 66/170 |
| 5,996,189 | A | 12/1999 | Wang | |
| 6,029,376 | A | 2/2000 | Cass | |
| 6,032,387 | A | 3/2000 | Johnson | |
| 6,052,921 | A | 4/2000 | Oreck | |
| 6,088,936 | A | 7/2000 | Bahl | |
| 6,151,802 | A | 11/2000 | Reynolds | |
| 6,170,175 | B1 | 1/2001 | Funk | |
| 6,308,438 | B1 | 10/2001 | Throneburg et al. | |
| 6,333,105 | B1 | 12/2001 | Tanaka et al. | |
| 6,397,638 | B1 * | 6/2002 | Roell | 66/61 |
| 6,401,364 | B1 | 6/2002 | Burt | |
| 6,558,784 | B1 | 5/2003 | Norton et al. | |
| 6,588,237 | B2 | 7/2003 | Cole et al. | |
| 6,754,983 | B2 | 6/2004 | Hatfield et al. | |
| 6,829,912 | B2 * | 12/2004 | Rempp et al. | 66/64 |
| 6,910,288 | B2 | 6/2005 | Dua | |
| 6,922,917 | B2 | 8/2005 | Kerns et al. | |
| 6,931,762 | B1 | 8/2005 | Dua | |
| D517,297 | S | 3/2006 | Jones et al. | |
| 7,051,460 | B2 | 5/2006 | Orei et al. | |
| 7,056,402 | B2 | 6/2006 | Koerwien et al. | |
| 7,347,011 | B2 | 3/2008 | Dua et al. | |
| 7,380,421 | B1 * | 6/2008 | Liu | 66/196 |
| 7,441,348 | B1 | 10/2008 | Dawson | |
| 7,543,397 | B2 | 6/2009 | Kilgore et al. | |
| 7,568,298 | B2 * | 8/2009 | Kerns | 36/50.1 |
| 7,682,219 | B2 | 3/2010 | Falla | |
| 7,774,956 | B2 * | 8/2010 | Dua et al. | 36/50.1 |
| 8,490,299 | B2 | 7/2013 | Dua et al. | |
| 8,631,589 | B2 * | 1/2014 | Dojan | 36/45 |
| 9,027,260 | B2 * | 5/2015 | Dua et al. | 36/50.1 |
| 2002/0078599 | A1 | 6/2002 | Delgorgue et al. | |
| 2002/0148258 | A1 | 10/2002 | Cole et al. | |
| 2003/0126762 | A1 | 7/2003 | Tseng | |
| 2003/0191427 | A1 | 10/2003 | Jay et al. | |
| 2004/0118018 | A1 | 6/2004 | Dua | |
| 2004/0181972 | A1 | 9/2004 | Csorba | |
| 2005/0115284 | A1 | 6/2005 | Dua | |
| 2005/0193592 | A1 | 9/2005 | Dua et al. | |
| 2005/0273988 | A1 | 12/2005 | Christy | |
| 2005/0284000 | A1 | 12/2005 | Kerns | |
| 2006/0059715 | A1 | 3/2006 | Aveni | |
| 2006/0162187 | A1 | 7/2006 | Byrnes et al. | |
| 2007/0022627 | A1 | 2/2007 | Sokolowski et al. | |
| 2007/0180730 | A1 | 8/2007 | Greene et al. | |
| 2007/0294920 | A1 | 12/2007 | Baychar | |
| 2008/0017294 | A1 | 1/2008 | Bailey et al. | |
| 2008/0078102 | A1 | 4/2008 | Kilgore et al. | |
| 2008/0110048 | A1 | 5/2008 | Dua et al. | |
| 2008/0110049 | A1 * | 5/2008 | Sokolowski et al. | 36/50.1 |
| 2008/0189830 | A1 | 8/2008 | Egglesfield | |
| 2008/0313939 | A1 | 12/2008 | Ardill | |
| 2009/0068908 | A1 | 3/2009 | Hinchcliff | |
| 2010/0043253 | A1 * | 2/2010 | Dojan et al. | 36/47 |
| 2010/0051132 | A1 | 3/2010 | Glenn | |
| 2010/0154256 | A1 | 6/2010 | Dua | |
| 2010/0170651 | A1 | 7/2010 | Scherb et al. | |
| 2010/0175276 | A1 * | 7/2010 | Dojan et al. | 36/47 |
| 2010/0251491 | A1 * | 10/2010 | Dojan et al. | 12/142 R |
| 2010/0251564 | A1 * | 10/2010 | Meschter | 36/28 |
| 2011/0030244 | A1 | 2/2011 | Motawi et al. | |
| 2011/0041359 | A1 * | 2/2011 | Dojan et al. | 36/47 |
| 2011/0078921 | A1 | 4/2011 | Greene et al. | |
| 2012/0233882 | A1 | 9/2012 | Huffa et al. | |
| 2012/0234052 | A1 | 9/2012 | Huffa et al. | |
| 2012/0255201 | A1 | 10/2012 | Little | |
| 2014/0068968 | A1 | 3/2014 | Podhajny et al. | |
| 2014/0196316 | A1 | 7/2014 | Follet | |

FOREIGN PATENT DOCUMENTS

| | | | |
|---|---|---|---|
| DE | 19738433 | | 4/1998 |
| DE | 19728848 | | 1/1999 |
| EP | 0279950 | A2 | 8/1988 |
| EP | 0448714 | | 7/1996 |
| EP | 0728860 | | 8/1996 |
| EP | 0758693 | | 2/1997 |
| EP | 0898002 | A2 | 2/1999 |
| EP | 1233091 | | 8/2002 |
| EP | 1437057 | A1 | 7/2004 |
| EP | 1563752 | A1 | 8/2005 |
| EP | 1602762 | A1 | 12/2005 |
| EP | 1972706 | A1 | 9/2008 |
| EP | 2 716 177 | A2 | 4/2014 |
| FR | 2171172 | | 9/1973 |
| FR | 2 571 387 | | 4/1986 |
| GB | 538865 | | 8/1941 |
| GB | 1 461 928 | | 1/1977 |
| GB | 2018837 | A | 10/1979 |
| GB | 1603487 | | 11/1981 |
| JP | H06113905 | | 4/1994 |
| JP | H08109553 | | 4/1996 |

(56) References Cited

FOREIGN PATENT DOCUMENTS

| | | | |
|---|---|---|---|
| JP | H11302943 | | 11/1999 |
| NL | 7304678 | | 10/1974 |
| WO | 9003744 | | 4/1990 |
| WO | 0032861 | | 6/2000 |
| WO | WO 02/04726 | A1 | 1/2002 |
| WO | 0231247 | | 4/2002 |
| WO | WO 2013/113339 | A1 | 8/2013 |

OTHER PUBLICATIONS

David J. Spencer, Knitting Technology: A Comprehensive Handbook and Practical Guide (Third ed., Woodhead Publishing Ltd. 2001) (413 pp).

Excerpt of Hannelore Eberle et al., Clothing Technology (Third English ed., Beuth-Verlag GmnH 2002) (book cover and back; pp. 2-3, 83).

International Search Report and Written Opinion in connection with PCT/US2009/056795 mailed on Apr. 20, 2010.

International Search Report and Written Opinion in connection with PCT/US2012/028576 mailed on Oct. 1, 2012.

International Search Report and Written Opinion in connection with PCT/US2012/028559 mailed on Oct. 19, 2012.

International Search Report and Written Opinion in connection with PCT/US2012/028534 mailed on Oct. 17, 2012.

International Preliminary Report on Patentability in connection with PCT/US2012/028534 mailed Sep. 17, 2013.

International Preliminary Report on Patentability in connection with PCT/US2012/028576 mailed Sep. 17, 2013.

International Search Report and Written Opinion of the International Searching Authority mailed Dec. 15, 2015 for PCT/US2015/052434 (13 pp.).

International Search Report and Written Opinion of the International Searching Authority mailed Jan. 29, 2016 for PCT/US2015/052453 (15 pp.).

International Search Report and Written Opinion of the International Searching Authority mailed Jan. 22, 2016 for PCT/US2015/052426 (13 pp.).

* cited by examiner

ARTICLE OF FOOTWEAR INCORPORATING A KNITTED COMPONENT WITH INLAID TENSILE ELEMENTS AND METHOD OF ASSEMBLY

CROSS-REFERENCE TO RELATED APPLICATION

This non-provisional patent application claims the benefit of priority under 35 U.S.C. §119(e) to U.S. Provisional Patent Application Ser. No. 62/057,264, which was filed in the U.S. Patent and Trademark Office on Sep. 30, 2014 and entitled "Article of Footwear Incorporating A Knitted Component with Inlaid Tensile Elements and Method of Assembly", the disclosure of which application is entirely incorporated herein by reference.

BACKGROUND

The present invention relates generally to articles of footwear, and, in particular, to articles of footwear incorporating knitted components.

Conventional articles of footwear generally include two primary elements, an upper and a sole structure. The upper is secured to the sole structure and forms a void on the interior of the footwear for comfortably and securely receiving a foot. The sole structure is secured to a lower area of the upper, thereby being positioned between the upper and the ground. In athletic footwear, for example, the sole structure may include a midsole and an outsole. The midsole often includes a polymer foam material that attenuates ground reaction forces to lessen stresses upon the foot and leg during walking, running, and other ambulatory activities. Additionally, the midsole may include fluid-filled chambers, plates, moderators, or other elements that further attenuate forces, enhance stability, or influence the motions of the foot. The outsole is secured to a lower surface of the midsole and provides a ground-engaging portion of the sole structure formed from a durable and wear-resistant material, such as rubber. The sole structure may also include a sockliner positioned within the void and proximal a lower surface of the foot to enhance footwear comfort.

The upper generally extends over the instep and toe areas of the foot, along the medial and lateral sides of the foot, under the foot, and around the heel area of the foot. In some articles of footwear, such as basketball footwear and boots, the upper may extend upward and around the ankle to provide support or protection for the ankle. Access to the void on the interior of the upper is generally provided by an ankle opening in a heel region of the footwear.

A variety of material elements (e.g., textiles, polymer foam, polymer sheets, leather, synthetic leather) are conventionally used in manufacturing the upper. In athletic footwear, for example, the upper may have multiple layers that each include a variety of joined material elements. As examples, the material elements may be selected to impart stretch-resistance, wear-resistance, flexibility, air-permeability, compressibility, comfort, and moisture-wicking to different areas of the upper. In order to impart the different properties to different areas of the upper, material elements are often cut to desired shapes and then joined together, usually with stitching or adhesive bonding. Moreover, the material elements are often joined in a layered configuration to impart multiple properties to the same areas. As the number and type of material elements incorporated into the upper increases, the time and expense associated with transporting, stocking, cutting, and joining the material elements may also increase.

Waste material from cutting and stitching processes also accumulates to a greater degree as the number and type of material elements incorporated into the upper increases. Moreover, uppers with a greater number of material elements may be more difficult to recycle than uppers formed from fewer types and numbers of material elements. By decreasing the number of material elements used in the upper, therefore, waste may be decreased while increasing the manufacturing efficiency and recyclability of the upper.

SUMMARY

In one aspect, a knitted component formed of unitary knit construction, where the knitted component includes a plurality of webbed areas that include a plurality of courses formed from a first yarn. The webbed areas are configured to move between a neutral position and an extended position. The webbed areas are biased to move toward the neutral position and to stretch toward the extended position in response to a force applied to the webbed areas. The knitted component also includes a plurality of tubular rib structures that are adjacent to the webbed areas. The tubular rib structures include a plurality of courses formed from a second yarn. The plurality of tubular rib structures include two co-extensive and overlapping knit layers and a central area that is generally unsecured to form a hollow between the two knit layers.

In another aspect, an article of footwear comprising a sole and an upper that is attached to the sole is disclosed. The upper includes a knitted component formed of unitary knit construction. The knitted component including a plurality of webbed areas and a plurality of tubular rib structures. The plurality of webbed areas including a plurality of courses formed from a first yarn. The tubular rib structures including a plurality of courses formed from a second yarn. The tubular rib structures are disposed adjacent to the webbed areas. The plurality of tubular rib structures include two co-extensive and overlapping knit layers and a central area that is generally unsecured to form a hollow between the two knit layers. The webbed areas are configured to move between a neutral position and an extended position. The webbed areas are biased to move toward the neutral position. The webbed areas are configured to stretch from the neutral position to the extended position in response to a force applied to the webbed areas.

In another aspect, a method of manufacturing a knitted component formed of unitary knit construction is disclosed. The method includes knitting a first plurality of courses to define a first webbed area of the knitted component. The knitted component is associated with a longitudinal direction and a lateral direction. The first webbed area is configured to move between a neutral position and an extended position. The first webbed area is biased toward the neutral position. The first webbed area is configured to stretch in the lateral direction toward the extended position of the first webbed area in response to a force applied to the first webbed area. The method where knitting the first plurality of courses includes extending the first plurality of courses along the longitudinal direction of the knitted component. The method also including knitting a second plurality of courses to define a first tubular rib structure of the knitted component. At least one of the first plurality of courses is joined with at least one of the second plurality of courses so as to form the first webbed area and the first tubular structure of unitary knit construction. The method where knitting the second plurality of courses includes extending the second plurality of courses along the longitudinal direction of the knitted component.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The present disclosure can be better understood with reference to the following drawings and description. The components in the figures are not necessarily to scale, emphasis instead being placed upon illustrating the principles of the present disclosure. Moreover, in the figures, like reference numerals designate corresponding parts throughout the different views.

DETAILED DESCRIPTION

The following discussion and accompanying figures disclose a variety of concepts relating to knitted components and the manufacture of knitted components. Although the knitted components may be used in a variety of products, an article of footwear that incorporates one of the knitted components is disclosed below as an example. In addition to footwear, the knitted component may be used in other types of apparel (e.g., shirts, pants, socks, jackets, undergarments), athletic equipment (e.g., golf bags, baseball and football gloves, soccer ball restriction structures), containers (e.g., backpacks, bags), and upholstery for furniture (e.g., chairs, couches, car seats). The knitted component may also be used in bed coverings (e.g., sheets, blankets), table coverings, towels, flags, tents, sails, and parachutes. The knitted component may be used as technical textiles for industrial purposes, including structures for automotive and aerospace applications, filter materials, medical textiles (e.g. bandages, swabs, implants), geotextiles for reinforcing embankments, agrotextiles for crop protection, and industrial apparel that protects or insulates against heat and radiation. Accordingly, the knitted component and other concepts disclosed herein may be incorporated into a variety of products for both personal and industrial purposes.

Figure 1:
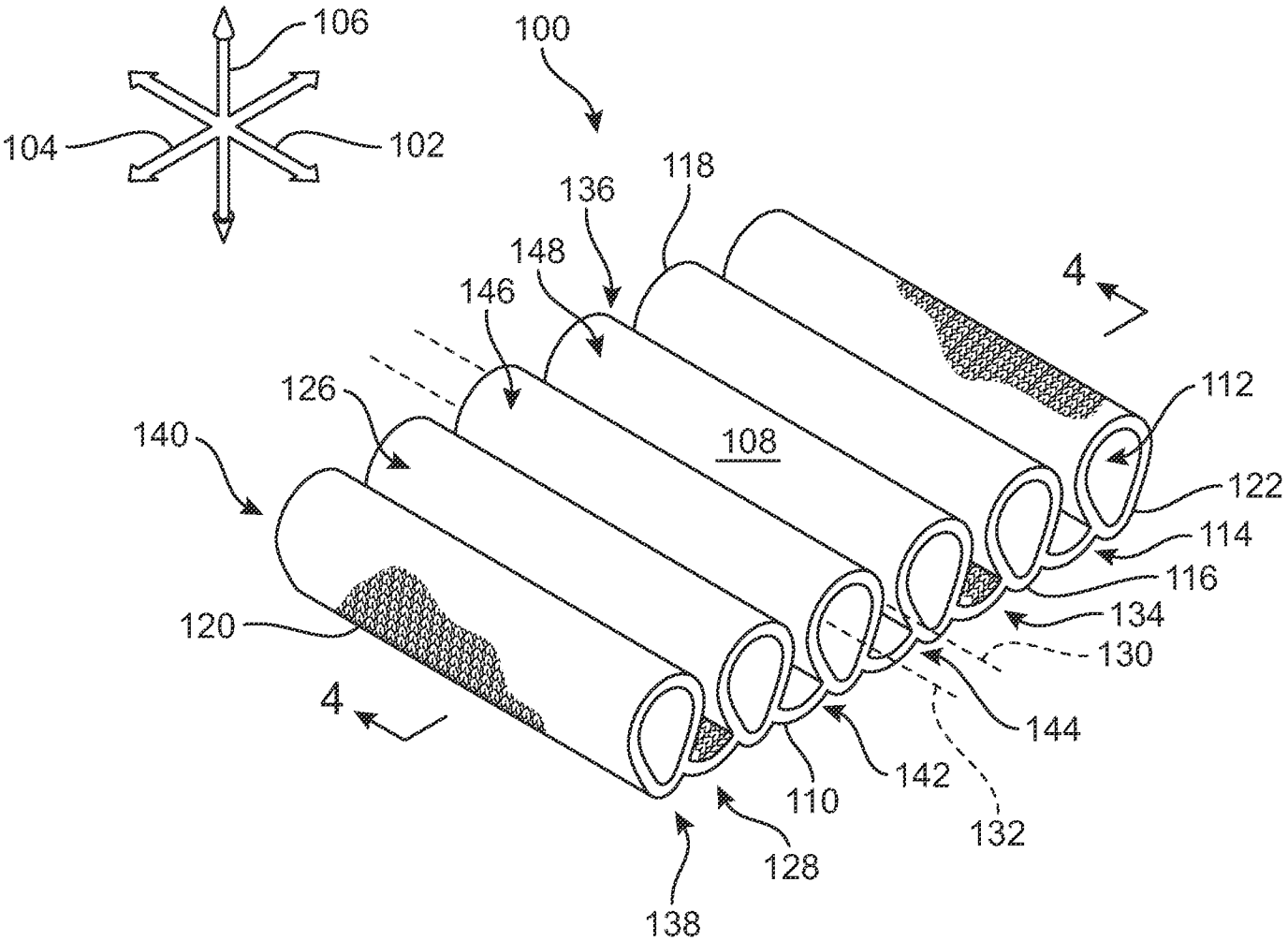
FIG. 1 is a perspective view of an embodiment of a knitted component, wherein the knitted component is shown in a first position.

FIG. 1 shows a knitted component 100 illustrated according to an exemplary embodiment of the present disclosure. In some embodiments, knitted component 100 may be provided with different structural portions that affect the properties and/or physical characteristics of knitted component 100. In an exemplary embodiment, at least a portion of knitted component 100 can include rib structures that provide strength and/or support to knitted component. In some cases, rib structures can be hollow tubes formed in knitted component 100 by co-extensive and overlapping knit layers that are closed to form the tube. In other cases, rib structures may include additional components that are disposed within the tubes, as will be described in more detail below.

In some embodiments, at least a portion of knitted component 100 extending between the rib structures can be flexible, elastic, and resilient. More specifically, in some embodiments, knitted component 100 can resiliently stretch, deform, compress, flex, or otherwise move between a first position and a second position. Additionally, knitted component 100 can be compressible and can recover from a compressed state to a neutral position in some embodiments.

Figure 2:
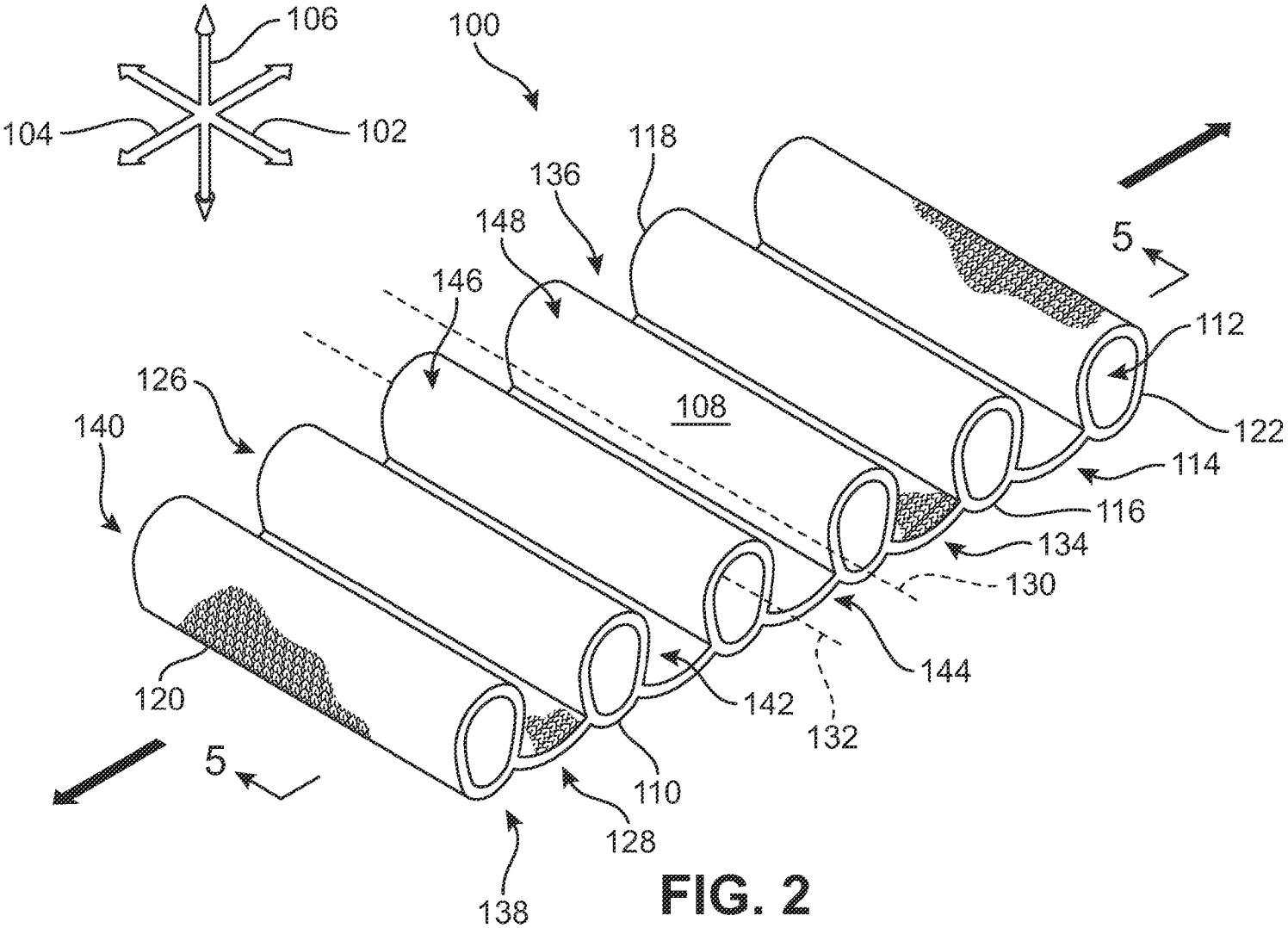
FIG. 2 is a perspective view of an embodiment of the knitted component of FIG. 1 shown in a second position.
Figure 3:
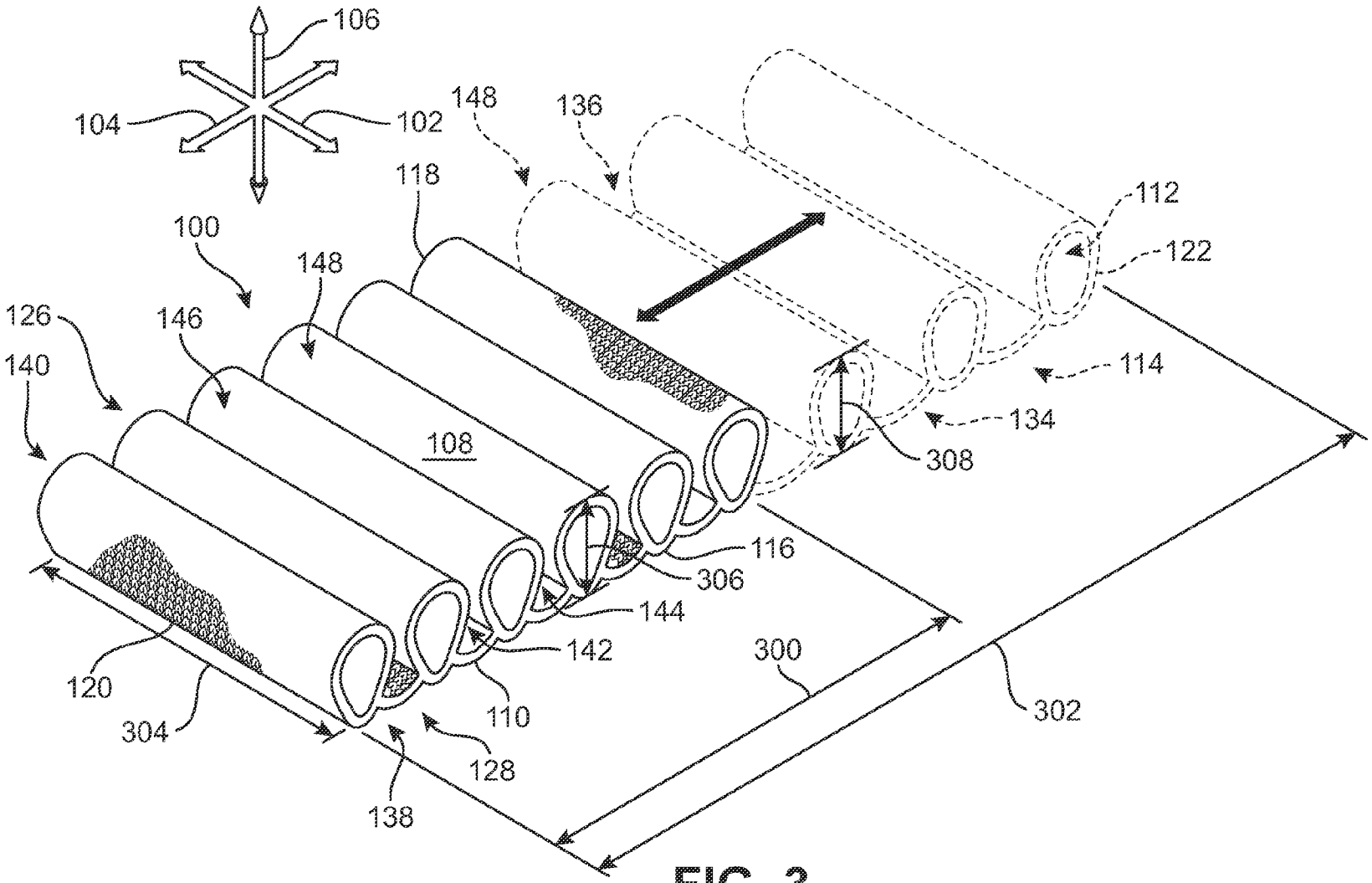
FIG. 3 is a perspective view of an embodiment of the knitted component, where the knitted component is shown in the first position with solid lines, and the knitted component is shown in the second position with broken lines.

FIG. 1 illustrates a first position of an embodiment of knitted component 100, and FIG. 2 illustrates a second position of an embodiment of knitted component 100. For purposes of clarity, FIG. 3 shows knitted component 100 in both positions, wherein the first position is represented in solid lines and the second position is represented in broken lines. In some embodiments, knitted component 100 can be biased to move toward the first position. Accordingly, in some embodiments, a force can be applied to knitted component 100 to move knitted component 100 to the second position. When released, in some embodiments, knitted component 100 can resiliently recover and return to the first position. In some embodiments, knitted component 100 can be subjected to a load, and as a result may compress or stretch. In other embodiments, knitted component 100 can recover to the first position of FIG. 1 once the compression load is reduced.

The resiliency and elasticity of knitted component 100 can provide benefits. For example, knitted component 100 can deform resiliently under a load, supplying a cushion against the load. Then, once the load is reduced, knitted component 100 can recover to its original position, and can continue to provide cushioning, structural reinforcement, and support. Additionally, the elasticity of knitted component 100 in the portions between adjacent rib structures can allow the arrangement of rib structures on knitted component 100 in various directions by adjusting the degree or amount of stretch, as will be further described below.

In an exemplary embodiment, knitted component 100 can include a plurality of rib structures arranged on various portions of knitted component 100. These rib structures are configured as non-planar areas that can be arranged such that knitted component 100 has a wavy, undulating, corrugated, or otherwise uneven appearance. In some embodiments, when knitted component 100 moves from the first position represented in FIG. 1 toward the second position represented in FIG. 2, knitted component 100 can become relatively flatter in the second position. In one embodiment, when moving back to the first position, the waviness of knitted component 100 can increase. In some embodiments, the waviness of knitted component 100 can increase the range of motion and stretchability of knitted component 100. Accordingly, in some embodiments, knitted component 100 can provide a high degree of dampening or cushioning.

Referring now to FIGS. 1-7, knitted component 100 is depicted as separate from an article of footwear. In some embodiments, a knitted component (for example, knitted component 100) according to the present disclosure can be incorporating into an upper of an article of footwear. In an exemplary embodiment, a knitted component may form a substantial majority of the upper of the article of footwear.

In various embodiments, knitted component 100 is formed of unitary knit construction. As used herein and in the claims, a knitted component (e.g., knitted component 100, or other knitted components described herein) is defined as being formed of "unitary knit construction" when formed as a one-piece element through a knitting process. That is, the knitting process substantially forms the various features and structures of knitted component 100 without the need for significant additional manufacturing steps or processes. A unitary knit construction may be used to form a knitted component having structures or elements that include one or more courses of yarn or other knit material that are joined such that the structures or elements include at least one course in common (i.e., sharing a common yarn) and/or include courses that are substantially continuous between each of the structures or elements. With this arrangement, a one-piece element of unitary knit construction is provided.

Although portions of knitted component 100 may be joined to each other (e.g., edges of knitted component 100 being joined together) following the knitting process, knitted component 100 remains formed of unitary knit construction because it is formed as a one-piece knit element. Moreover, knitted component 100 remains formed of unitary knit construction when other elements (e.g., a lace, logos, trademarks, placards with care instructions and material information, structural elements) are added following the knitting process.

In different embodiments, any suitable knitting process may be used to produce knitted component 100 formed of unitary knit construction, including, but not limited to a warp knitting or a weft knitting process, including a flat knitting process or a circular knitting process, or any other knitting process suitable for providing a knitted component. Examples of various configurations of knitted components and methods for forming knitted component 100 with unitary knit construction are disclosed in U.S. Pat. No. 6,931,762 to Dua; and U.S. Pat. No. 7,347,011 to Dua, et al., the disclosure of each being incorporated by reference in its entirety. In an exemplary embodiment, a flat knitting process may be used to form knitted component 100, as will be described in more detail.

For reference purposes, knitted component 100 is illustrated with respect to a Cartesian coordinate system in FIGS. 1-7. Specifically, a longitudinal direction 102, a lateral direction 104, and a thickness direction 106 of knitted component 100 are shown. However, knitted component 100 can be illustrated relative to a radial coordinate system or other coordinate system.

As shown in FIGS. 1-3, some embodiments of knitted component 100 can include a front surface 108 and a back surface 110. Moreover, knitted component 100 can include a peripheral edge 114 in different embodiments. Peripheral edge 114 can define the boundaries of knitted component 100. In one embodiment, knitted component 100 may have a thickness visible along peripheral edge 114 that extends in thickness direction 106 between front surface 108 and back surface 110. In some embodiments, peripheral edge 114 of knitted component 100 may extend around a periphery of knitted component 100 and may be further sub-divided into any number of sides, depending on the configuration of the knitted component. For example, in one embodiment of knitted component 100, peripheral edge 114 can include four sides defining an approximately rectangular shape of knitted component 100 as shown in FIGS. 1-3.

More specifically, in some embodiments, as shown in FIGS. 1-3, peripheral edge 114 of knitted component 100 can be sub-divided into a first edge 116, a second edge 118, a third edge 120, and a fourth edge 122. First edge 116 and second edge 118 can be spaced apart in longitudinal direction 102. Third edge 120 and fourth edge 122 can be spaced apart in lateral direction 104. Third edge 120 can extend between first edge 116 and second edge 118, and fourth edge 122 can also extend between first edge 116 and second edge 118. In some embodiments, knitted component 100 can be generally rectangular. However, it will be appreciated that knitted component 100 can define any shape without departing from the scope of the present disclosure, including regular and irregular (non-geometrical) shapes.

In different embodiments, front surface 108 and/or back surface 110 of knitted component 100 can be rippled, wavy, bumpy, undulated, corrugated or otherwise uneven and non-planar. Any waviness may be intermittent or continuous. It will also be appreciated that in some embodiments, knitted component 100 can include a series of non-planar features or constructions. For example, knitted component 100 can include ribs, tunnels, peaks and troughs, corrugations, steps, raised ridges and recessed channels, or other uneven features formed by the knit structure of knitted component 100. Such features where they occur can extend across knitted component 100 in any direction. In some embodiments, knitted component 100 can include a plurality of tubular rib structures 126 and a plurality of webbed areas 128. For purposes of this description, tubular rib structures 126 and webbed areas 128 will be referred to collectively as "ribbed features".

Generally, tubular rib structures 126 can be areas of knitted component 100 constructed with two or more co-extensive and overlapping knit layers. Knit layers may be portions of knitted component 100 that are formed by knitted material, for example, threads, yarns, or strands. Two or more knit layers may be formed of unitary knit construction in such a manner so as to form tubes or tunnels, identified as tubular rib structures 126, in knitted component 100. Although the sides or edges of the knit layers forming tubular rib structures 126 may be secured to the other layer, a central area is generally unsecured to form a hollow between the two layers of knitted material forming each knit layer. In some embodiments, the central area of tubular rib structures 126 may be configured such that another element (e.g., a tensile element) may be located between and pass through the hollow between the two knit layers forming tubular rib structures 126.

Knitted component 100 can include any suitable number of tubular rib structures 126. In some embodiments, two or more tubular rib structures 126 of knitted component 100 can have similar shape and dimensions to each other. In other embodiments, the shape and dimensions of tubular rib structures 126 can vary across knitted component 100. In some embodiments, tubular rib structures 126 can generally be shaped as a cylinder. In an exemplary embodiment, tubular rib structures 126 may have an elongated cylindrical shape with a wider top portion associated with front surface 108 and a narrower lower portion associated with back surface 110. In other embodiments, tubular rib structures 126 can be shaped as a generally circular or elliptical cylinder. Knitted component can include differently shaped tubular rib structures 126.

Generally, webbed areas 128 may be connecting portions between various elements and/or components of knitted component 100. Webbed areas 128 are formed of unitary knit construction with the remaining portions of knitted component 100 and may serve to connect various portions together as a one-piece knit element. Knitted component 100 can include any suitable number of webbed areas 128. In different embodiments, webbed areas 128 can be an area of knitted component 100 comprising one knit layer. In some embodiments, webbed areas 128 may extend between one portion of knitted component and another portion of knitted component 100. In one embodiment, webbed areas 128 can extend between one tubular rib structure and another tubular rib structure. In a different embodiment, webbed areas 128 may extend between one tubular rib structure and another portion of knitted component 100. In another embodiment, webbed area 128 may extend between one tubular rib structure and an edge of knitted component 100.

In some embodiments, webbed areas 128 may be disposed in an alternating manner between two or more tubular rib structures 126. In an exemplary embodiment, webbed areas 128 can extend between and connect two or more adjacent tubular rib structures 126. With this configuration, webbed areas 128 and tubular rib structures 126 are formed together with knitted component 100 of unitary knit construction.

Figure 4:
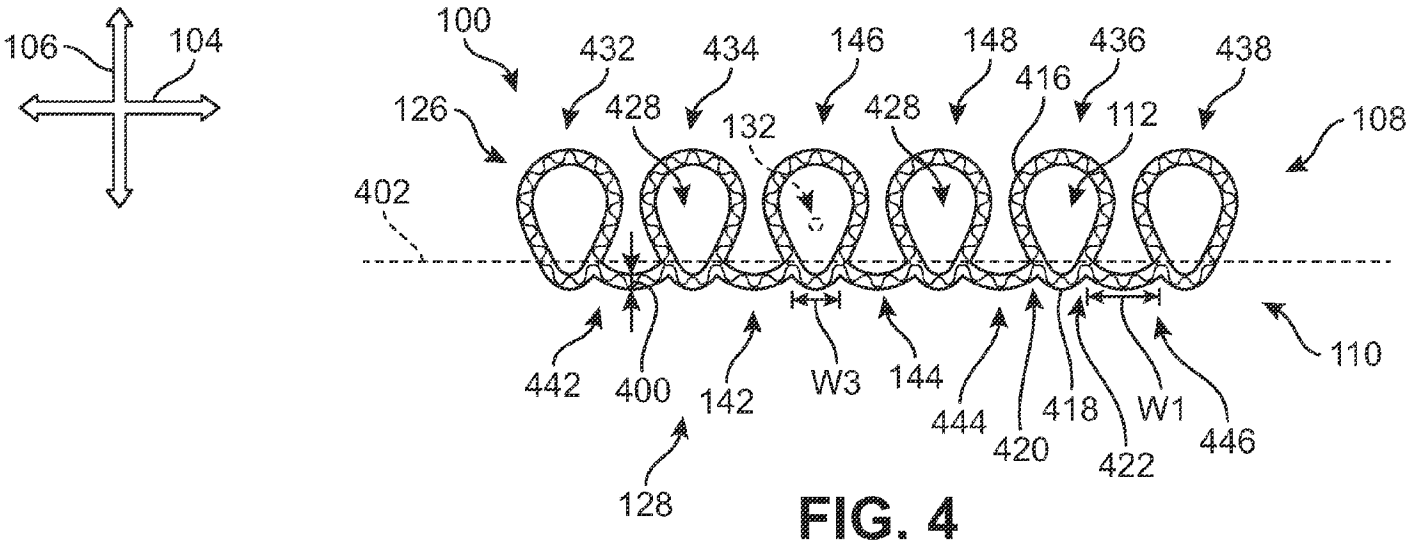
FIG. 4 is a cross section of an embodiment of the knitted component taken along the line 4-4 of FIG. 1.
Figure 5:
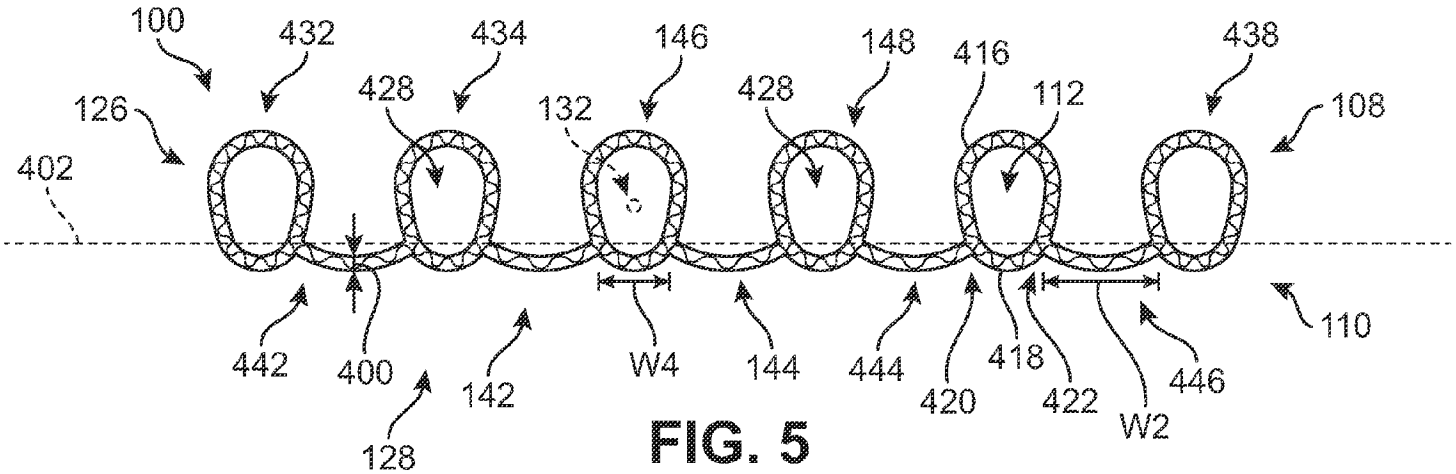
FIG. 5 is a cross section of an embodiment of the knitted component taken along the line 5-5 of FIG. 2.

Moreover, as shown in FIGS. 4 and 5, knitted component 100 can have a knit layer thickness 400 that is measured from front surface 108 to back surface 110 of some areas. In some embodiments, knit layer thickness 400 can be substantially constant throughout knitted component 100. In other embodiments, knit layer thickness 400 can vary with certain portions being thicker than other portions. It will be appreciated that in some embodiments, knit layer thickness 400 can be selected and controlled according to the diameter of yarn(s) used. Knit layer thickness 400 can also be controlled according to the denier of the yarn(s) in another embodiment. Additionally, in other embodiments, knit layer thickness 400 can be controlled according to the stitch density within knitted component 100.

As mentioned, knitted component 100 can be resiliently flexible, compressible, and stretchable. Webbed areas 128 and/or tubular rib structures 126 can flex, deform, or otherwise move as knitted component 100 stretches. For example, in the first position of FIGS. 1 and 4, webbed areas 128 can remain relatively compressed and compact. In the second position of FIGS. 2 and 5, webbed areas 128 can be relatively more extended and stretched. Furthermore, stretching of webbed areas 128 may result in a stretching and flattening of knitted component 100. In addition, in some embodiments, tubular rib structures 126 can compress or extend.

The first position of knitted component 100 shown in FIGS. 1 and 4 can also be referred to as an unstretched position or a neutral position in some embodiments. The second position represented in the embodiments of FIGS. 2 and 5 can also be referred to as a stretched position or an extended position.

If knitted component 100 is stretched to the second position, the resilience and elasticity of knitted component 100 can allow knitted component 100 to recover and move back toward the first position represented in FIGS. 1 and 4 once the stretching force is removed. Stated differently, knitted component 100 can be biased toward the first position.

As shown in FIG. 3, movement of knitted component 100 from the first position to the second position can cause knitted component 100 to stretch and elongate in lateral direction 104 in some embodiments. More specifically, as shown in FIG. 3, knitted component 100 can have a first width 300 in the first position, measured from third edge 120 to fourth edge 122 along lateral direction 104. In contrast, knitted component 100 can have a second width 302 which is longer than first width 300, as shown in FIG. 4. It will be appreciated that knitted component 100 can have varying widths as it is stretched. In some cases first width 300 and/or second width 302 may each vary, depending in part on the materials comprising knitted component 100 and the amount of force applied.

As seen in FIG. 3, knitted component 100 can also have an overall length 304 that is measured between first edge 116 and second edge 118 along longitudinal direction 102. In some embodiments, length 304 can remain substantially constant. In other embodiments, knitted component 100 can exhibit some stretchability in longitudinal direction 102 such that length 304 is variable. In one embodiment, webbed areas 128 and tubular rib structures 126 may stretch in longitudinal direction 102. In some embodiments, knitted component 100 can stretch in response to a force along longitudinal direction 102 such that length 304 increases. In other embodiments, knitted component 100 can exhibit a significantly higher degree of stretchability in lateral direction 104 than in longitudinal direction 102.

Furthermore, knitted component 100 can have a body thickness that changes as knitted component 100 moves. Body thickness refers to the height of tubular rib structures 126 in knitted component 100 in thickness direction 106. For example, in some embodiments, body thickness can vary as the curvature of tubular rib structures 126 change as knitted component 100 stretches and compresses. Specifically, as shown in FIG. 3, knitted component 100 has a first body thickness 306 in the first position, depicted in solid lines, and knitted component 100 has a second body thickness 308 in the second position, depicted in broken lines. In FIG. 3, first body thickness 306 is greater than second body thickness 308.

In addition, different areas of knitted component 100 can have different body thicknesses. In different embodiments, one portion of knitted component 100 may have a greater body thickness than another portion of knitted component 100. In another embodiment, some tubular rib structures of knitted component 100 may experience greater stretching and have a body thickness that is less than the body thickness of other tubular rib structures in knitted component 100.

Webbed areas 128 and tubular rib structures 126 of knitted component 100 will now be discussed in greater detail. In some embodiments, webbed areas 128 can be elongated and substantially straight, as shown in FIGS. 1-3. More specifically, webbed areas 128 can extend longitudinally along a respective web axis 130, one of which is indicated in FIG. 1 as an example. Webbed areas 128 can include a first longitudinal ends 134 and a second longitudinal ends 136, as shown in FIG. 2. Similarly, tubular rib structures 126 can extend longitudinally along a respective tubular axis 132, one of which is indicated in FIG. 1 as an example. Tubular rib structures 126 can include a first longitudinal ends 138 and a second longitudinal ends 140, as shown in FIGS. 1 and 2. In some embodiments, web axis 130 and tubular axis 132 can be substantially straight and parallel to longitudinal direction 102. In other embodiments, web axis 130 and/or tubular axis 132 can be curved relative to longitudinal direction 102. Also, in some embodiments, webbed areas 128 and tubular rib structures 126 can be nonparallel relative to each other. In one embodiment, tubular rib structures 126 may exhibit greater curvature than webbed areas 128. In another embodiment, webbed areas 128 may exhibit greater curvature than tubular rib structures 126.

Additionally, in some embodiments, as shown in FIG. 2, first longitudinal ends 134 of webbed areas 128 can be disposed proximate first edge 116 of knitted component 100, and second longitudinal ends 136 of webbed areas 128 can be disposed proximate second edge 118 of knitted component 100. Likewise, first longitudinal ends 138 of tubular rib structures 126 can be disposed proximate to first edge 116 of knitted component 100, and second longitudinal ends 140 of tubular rib structures 126 can be disposed proximate to second edge 118 of knitted component.

Furthermore, in some embodiments, first longitudinal ends 134 of webbed areas 128 and first longitudinal ends 138 of tubular rib structures 126 can cooperate to define first edge 116 of knitted component 100. Similarly, second longitudinal ends 136 of webbed areas 128 and second longitudinal ends 140 of tubular rib structures 126 can cooperate to define second edge 118 of knitted component 100 in some embodiments.

Webbed areas 128 can include a first webbed area 142. In some embodiments, first webbed area 142 can be representative of other webbed areas 128. Referring to FIGS. 1-5, in different embodiments, first webbed area 142 may be curved or may lie relatively flat along the lateral direction 104. In one embodiment, first webbed area 142 can be generally flat. In other embodiments, first webbed area 142 can be curved or angled. In some embodiments, first webbed area 142 can be concave on front surface 108. In other embodiments, first webbed area 142 can be convex on front surface 108.

It should be understood that in some embodiments, webbed areas 128 can be stretched to a greater extent relative to other embodiments, resulting in a substantially flattened shape of knitted component 100. In these embodiments, webbed areas 128 may comprise a relatively more planar than rounded shape.

In some embodiments, webbed areas 128 of knitted component 100 can have a similar shape and dimensions to other webbed areas 128. In other embodiments, the shape and dimensions of webbed areas 128 can vary across knitted component 100.

In different embodiments, tubular rib structures 126 can include a first tubular structure 146. In some embodiments, first tubular structure 146 can be representative of other tubular rib structures 126. First tubular structure 146 can have a tube shape in some embodiments. When viewed in cross-section, as shown in FIGS. 4 and 5, tubular rib structures 126 can include a first curved portion 416 and a second curved portion 418. In an exemplary embodiment, first curved portion 416 is disposed opposite of second curved portion 418 on the respective top and bottom of tubular rib structures 126. In some embodiments, first curved portion 416 and second curved portion 418 may be knitted together to define the tube forming tubular rib structure 126. In the embodiment of FIGS. 4 and 5, first curved portion 416 and second curved portion 418 meet along a first transition 420 edge and also along a second transition 422 edge, forming a tunnel or tube shape.

In some embodiments, first curved portion 416 can comprise a portion of front surface 108 of knitted component. In some embodiments, second curved portion 418 can comprise a portion of back surface 110 of knitted component 100. Together, first curved portion 416 and second curved portion 418 may comprise two sides of first tubular structure 146. In different embodiments, first curved portion 416 may be comprised of one knit layer and second curved portion 418 may be comprised of another knit layer.

Various areas of first tubular structure 146 can comprise different shapes. In different embodiments, first curved portion 416 and second curved portion 418 can move and change shape. In some embodiments, first curved portion 416 and/or second curved portion 418 can be relatively level or flattened. In other embodiments, first curved portion 416 and/or second curved portion 418 can be rounded or curve by varying amounts.

In other embodiments, first curved portion 416 and/or second curved portion 418 can comprise curved areas of tubular rib structures 126. First curved portion 416 and/or second curved portion 418 can be curved or bent to a greater degree in some embodiments, and to a lesser degree in other embodiments. For example, in some embodiments, the amount of courses of knit material forming first curved portion 416 and/or second curved portion 418 may be varied to change the associated degree or amount of curvature of the respective first curved portion 416 and/or second curved portion 418. Additionally, the direction of the curvature of each of first curved portion 416 and/or second curved portion 418 may vary. In one embodiment, first curved portion 416 and/or second curved portion 418 may be provided such that first tubular structure 146 can be convex on front surface 108 and convex on back surface 110.

In different embodiments, tubular rib structures 126 can define one or more hollow tubes. A hollow tube 112 may be a generally unsecured area disposed between first curved portion 416 and second curved portion 418 of tubular rib structure that has the configuration of a tunnel or channel. In some embodiments, first tubular structure 146 may comprise a generally cylindrical or elliptical shape, with hollow tube 112 extending throughout the length of first tubular structure 146 in a longitudinal direction 102. In some embodiments, hollow tube 112 may form a tunnel within tubular rib structures 126, and may extend partway along the length of tubular rib structures 126. In other embodiments, hollow tube 112 may extend throughout the full length of tubular rib structures 126. The diameter of one hollow tube and the diameter of other hollow tubes may differ in some embodiments, as discussed further below.

In different embodiments, webbed areas 128 and tubular rib structures 126 may be arranged in various configurations. As shown in FIG. 4, webbed areas 128 and tubular rib structures 126 can be spaced apart relative to each other. For example, in some embodiments, webbed areas 128 and tubular rib structures 126 can be spaced apart in lateral direction 104. Also, in some embodiments, webbed areas 128 and tubular rib structures 126 can be arranged in an alternating pattern across knitted component 100. More specifically, as shown in FIGS. 1-5, webbed areas 128 can include first webbed area 142 and a second webbed area 144. Likewise, tubular rib structures 126 can include first tubular structure 146 as well as a second tubular structure 148. First tubular structure 146 can be disposed between and can separate first webbed area 142 and second webbed area 144. Furthermore, first webbed area 142 can be disposed between and can separate first tubular structure 146 and second tubular structure 148. This alternating arrangement can be repeated across knitted component 100 in lateral direction 104 in some embodiments.

In some embodiments, such as those shown in FIGS. 4 and 5, knitted component 100 can further include a third tubular structure 432, a third webbed area 442, a fourth tubular structure 434, a fourth webbed area 444, a fifth tubular structure 436, a fifth webbed area 446, and a sixth tubular structure 438. Third tubular structure 432 can define third edge 120 of knitted component 100. Moving away from third edge 120 in lateral direction 104, third webbed area 442 is disposed adjacent to third tubular structure 432. Also, fourth tubular structure 434 is disposed adjacent third webbed area 442, and second webbed area 144 is disposed adjacent fourth tubular structure 434. As stated, first webbed area 142 is disposed adjacent second tubular structure 148, first tubular structure 146 is disposed adjacent first webbed area 142, and second webbed area 144 is disposed adjacent first tubular structure 146. Additionally, second tubular structure 148 is disposed adjacent to fourth webbed area 444, fourth webbed area 444 is disposed adjacent to fifth tubular structure 436. Fifth tubular structure 436 is disposed adjacent to fifth webbed area 446, and fifth webbed area 446 is disposed adjacent to sixth tubular structure 438. Sixth tubular structure 438 can define fourth edge 122.

Webbed areas 128 and tubular rib structures 126 can be directly adjacent and attached to each other in some embodiments. More specifically, as shown in the embodiment of FIG. 5, first webbed area 142 can be attached to first tubular structure 146 at first transition 420. First webbed area 142 is also attached to second tubular structure 148 at second transition 422. This arrangement can be repeated among other adjacent pairs of webbed areas and tubular rib structures as well.

In other embodiments the arrangement of the webbed areas and tubular rib structures may differ. In one embodiment, two or more webbed areas may be disposed adjacent to one another within knitted component 100. In another embodiment, two or more tubular rib structures may be disposed adjacent one another within knitted component 100. In some embodiments, the webbed areas and/or tubular rib structures may be disposed adjacent to other portions of knitted component 100.

In different embodiments, the position of webbed areas 128 and tubular rib structures 126 may vary as knitted component 100 moves between the first position of FIGS. 1 and 4 and the second position of FIGS. 2 and 5. As shown in FIG. 4, webbed areas 128 can be in a compacted or unstretched position when knitted component 100 is in the first position. In some embodiments, tubular rib structures 126 can similarly be in a compacted or unstretched position when knitted component 100 is in the first position. In contrast, as shown in FIG. 5, webbed areas 128 can be in an extended or stretched position when knitted component 100 is in the second position, and tubular rib structures 126 can similarly be in an extended or stretched position when knitted component 100 is in the second position. The lateral width of webbed areas 128 can be smaller in the neutral position as compared to the extended position. In addition, as seen in FIGS. 4-5, the midpoints of first curved portion 416 and second curved portion 418 of tubular rib structures 126 can be closer together in the stretched position as compared to the unstretched position, as body thickness changes from first body thickness 306 to second body thickness 308, as shown in FIG. 3. Similarly, as shown in FIGS. 4 and 5, in some embodiments, first transition 420 can be closer to second transition 422 in the relaxed or neutral position than in the extended or stretched position. This is due in part to the change in curvature of first curved portion 416 and second curved portion 418 about the respective tubular axis 132 when moving between the compacted and extended positions associated with the neutral or unstretched first position of knitted component 100 and the extended or stretched second position of knitted component 100. This can be seen as first curved portion 416 and second curved portion 418 move closer to imaginary reference plane 402 from FIG. 4 to FIG. 5.

In some embodiments, the arrangement of adjacent tubular rib structures 126 may be provided such that webbed areas 128 disposed between each pair of adjacent tubular rib structures 126 is at least partially obscured from visual observation in the neutral or unstretched position when viewed from top surface 108. That is, first curved portion 416 of each adjacent tubular rib structure 126 may be touching or close to each other such that webbed area 128 below is not visible in the unstretched position of knitted component 100. When some force is applied to knitted component 100 to move knitted component 100 from the unstretched position to the stretched position, the relative positions of webbed areas 128 and tubular rib structures 126 are moved apart from neutral positions to extended positions, and the underlying webbed areas 128 may then be revealed for visual observation from top surface 108. In an exemplary embodiment, webbed areas 128 may be knitted using a contrasting type or color of yarn than tubular rib structures 126, such that when moving knitted component 100 from the unstretched position to the stretched position, the contrast of webbed area 128 is revealed to visual observation from top surface 108.

In different embodiments, webbed areas 128 and tubular rib structures 128 can have different degrees of stretch as knitted component moves from the unstretched or neutral position to the stretched or extended position. For example, in FIG. 4, fifth webbed area 446 has a width W1, and first tubular structure 146 has a width W2. In FIG. 5, fifth webbed area 446 has a width W2 and first tubular structure 146 has a width W4. As knitted component 100 moves from the first position of FIG. 4 to the second position of FIG. 5, width W1 increases to width W2, and width W3 increases to width W4. In some embodiments, the lateral stretch that occurs along webbed areas 128 can be greater than the stretch that occurs along tubular rib structures 126. For example, in one embodiment, the percentage of increase from width W1 to width W2 may be greater than the percentage of increase from width W3 to width W4. In some embodiments, this difference may result from the particular construction of tubular rib structures 126, where two knit layers (for example, first curved portion 416 and second curved portion 418) are joined together, which can constrain the amount of stretch. In other embodiments, this difference can be due to the strand selected in the knitting of tubular rib structures 126, and/or the inclusion of other material within openings 112 of tubular rib structures 126, such as tensile elements, as discussed further below.

Additionally, in some embodiments, webbed areas 128 and/or tubular rib structures 126 can be biased toward the neutral position represented in FIGS. 1 and 4. In some embodiments, webbed areas 128 and tubular rib structures 126 can respond to a force by moving toward the extended or stretched position represented in FIGS. 2 and 5. Once the stretching force is reduced, webbed areas 128 and tubular rib structures 126 can recover back to the neutral position represented in FIGS. 1 and 4. When the load is removed, the resilience of knitted component 100 and biasing provided by webbed areas 128 and tubular rib structures 126 can provide recovery of knitted component 100 back to the position of FIG. 4.

In different embodiments, knitted component 100 can be modified to limit the recovery from a stretched position to a more compact position. In some embodiments, this process is favored when knitted component 100 can be comprised at least partially of a fusible material. In one embodiment, the material may include a thermoplastic polymer material. In general, a thermoplastic polymer material softens or melts when heated and returns to a solid state when cooled. Although a wide range of thermoplastic polymer materials may be utilized in knitted component 100, examples of possible thermoplastic polymer materials include thermoplastic polyurethane, polyamide, polyester, polypropylene, and polyolefin.

In some configurations, knitted component 100 may be entirely, substantially, or partially formed from one or more thermoplastic polymer materials. Advantages of forming knitted component 100 from a thermoplastic polymer material are uniform properties, the ability to form thermal bonds, efficient manufacture, elastomeric stretch, and relatively high stability or tensile strength. Although a single thermoplastic polymer material may be utilized, individual strands in knitted component 100 may be formed from multiple thermoplastic polymer materials. Additionally, while each strand may be formed from a common thermoplastic polymer material, different strands may also be formed from different materials. As an example, some strands in knitted component 100 may be formed from a first type of thermoplastic polymer material, whereas other strands of knitted component 100 may be formed from a second type of thermoplastic polymer material, and further strands in knitted component 100 may be formed of a different material.

The thermoplastic polymer material may be selected to have various stretch and fusible properties, and the material may be considered elastomeric. As a related matter, the thermoplastic polymer material utilized may be selected to have various recovery properties. That is, knitted component 100 may be formed to return to an original, neutral shape after being stretched. However, in different embodiments, knitted component 100 may be formed and/or treated so that different portions include different capacities for stretch and recovery.

Knitted component 100 may be maintained in various neutral configurations as a result of different treatments to material forming knitted component 100. Knitted component 100 may be treated in some manner to inhibit recovery to original position. Treatments may include chemical treatment, application of heat, alterations in manufacturing or material, or other treatments. The materials used in formation of knitted component 100 may influence the selection of treatment. In one embodiment, fusible materials may be selected to permit the use of heat to maintain a stretched position. Thus, in some embodiments, one or more portions of a knitted component 100 can remain in a stretched position, where the elastic recovery properties of the material are decreased.

Thus, in some embodiments, stretch in one or more areas may be maintained. In other words, areas of knitted component 100 may remain stretched relative to other areas even without a compression load. In some embodiments, the degree of stretch in one area and the degree of stretch in another area can differ. As a result, the width of one area of knitted component 100 can also differ from the widths of other areas of knitted component 100 that include the same number of ribbed features. Depending on the extent of stretch present, one section of knitted component 100 comprising a series of ribbed features may have an average width that is greater than the average width of another section of knitted component 100 comprising the same set of ribbed features. Thus, knitted component 100 may include varying levels of stretch throughout the component which can be maintained even in the absence of compression loads.

In addition, it should be noted that the orientation of ribbed features may also change as knitted component 100 is stretched in various ways. This aspect will be discussed in greater detail below, with respect to articles incorporating a knitted component.

In different embodiments, as shown in FIGS. 6-10, one or more tensile elements 600 can be incorporated in knitted component 100. Tensile elements 600 can provide support to knitted component 100. Stated differently, tensile elements 600 can allow knitted component 100 to resist deformation, stretching, or otherwise provide support for the wearer's foot during running, jumping, or other movements. Tensile elements may be arranged in such a manner as to improve performance characteristics. Tensile elements can enhance strength, support, and provide structural reinforcement.

In some embodiments, tensile elements 600 can be incorporated, inlaid, or extended into one or more tubular rib structures during the unitary knit construction of the knitted component 100. Stated another way, tensile elements 600 can be incorporated during the knitting process of knitted component 100. In one embodiment, tensile elements 600 can be extended across the tubular structure. In some embodiments, tensile elements 600 may lie within the tunnels formed by first curved portion 416 and second curved portion 418 of tubular rib structures.

Figure 6:
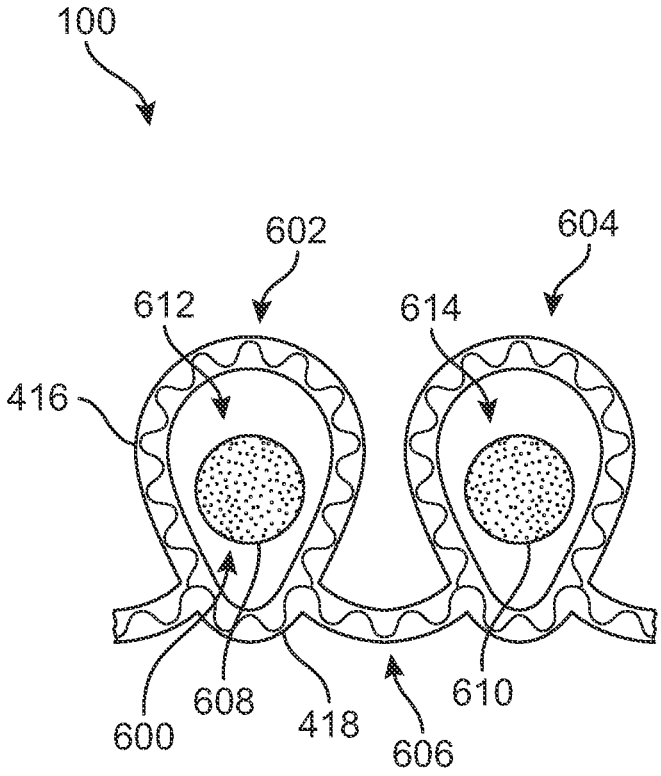
FIG. 6 is a cross section of an embodiment of the knitted component including tensile elements.

In FIG. 6, a cross section of a portion of knitted component 100 is shown. A first tubular structure 602 and a second tubular structure 604 are depicted, with a webbed area 606 disposed between the two tubular rib structures. Tensile elements 600 can be inlaid during the unitary knit construction of knitted component 100 such that a first cable 608 is disposed in the tunnel of first tubular structure 602 and a second cable 610 is disposed in the tunnel of second tubular structure 604. First cable 608 and second cable 610 are shown independent of one another. However, in some embodiments, first cable 608 and second cable 610 may be comprised of a single, continuous length of cable.

Figure 7:
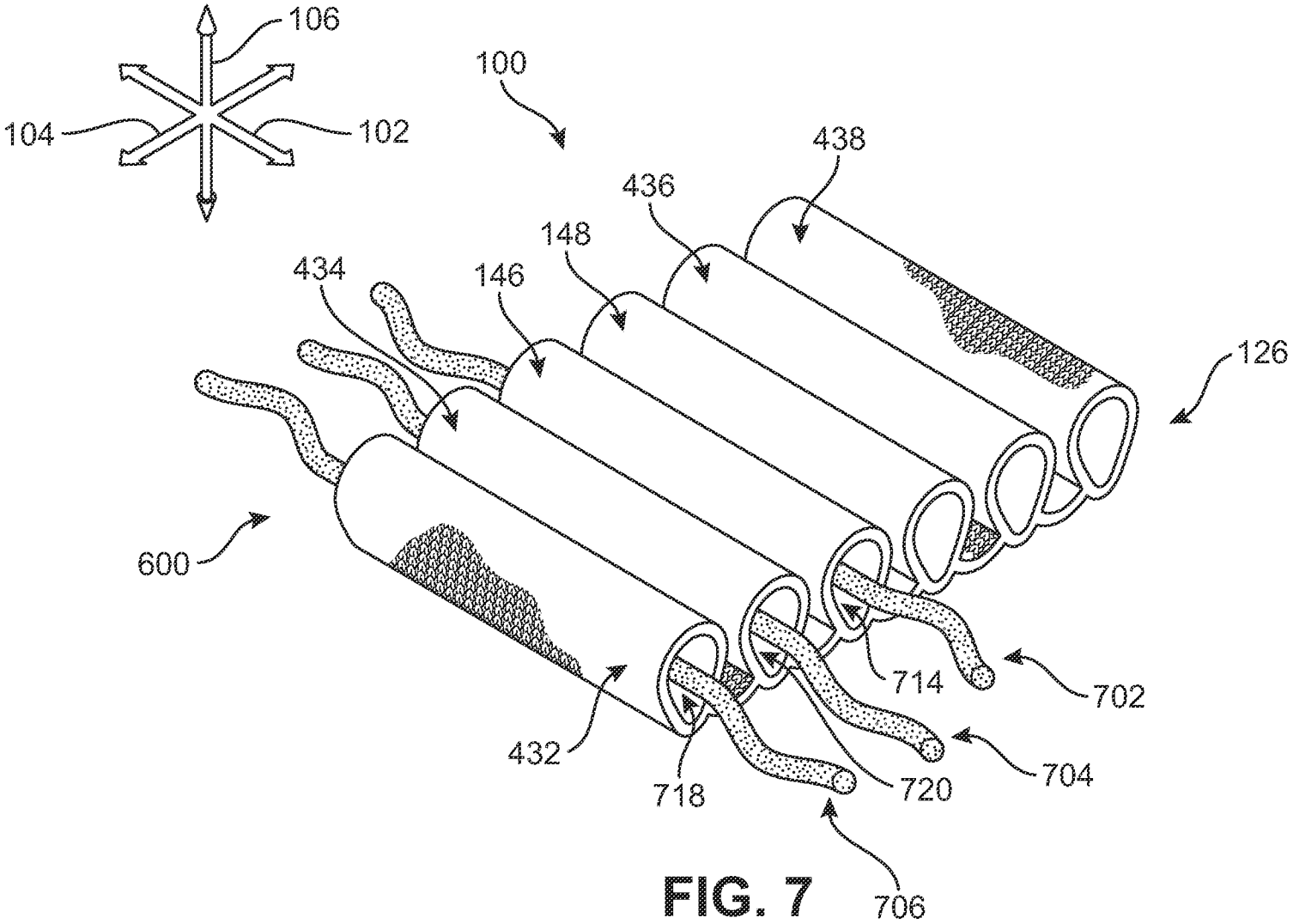
FIG. 7 is a perspective view of an embodiment of the knitted component including tensile elements.

Tensile elements 600 may extend along one or more tubular rib structures, as shown in FIG. 7. In different embodiments, tensile elements 600 may be arranged in various configurations though knitted component 100. Tensile elements 600 may be present in some or all tubular rib structures. Tensile elements 600 may be arranged in various patterns or at varying intervals along knitted component 100. In FIG. 7, a knitted component 100 is shown with tensile elements 600 disposed along the tunnels of half of the depicted tubular rib structures, or in this case, three of the six tubular rib structures. In the embodiment of FIG. 7, a first cable 702, a second cable 704, and a third cable 706 are shown. First cable 702 extends along the tunnel 714 of first tubular structure 146, second cable 704 extends along the tunnel 720 of fourth tubular structure 434, and third cable 706 extends along the tunnel 718 of third tubular structure 432. It is important to note that while first cable 702, second cable 704, and third cable 706 are depicted as independent of one another, in some embodiments, first cable 702, second cable 704, and third cable 706 may be comprised of a single, continuous length of cable. In other words, a single cable may emerge from tunnel 714 of first tubular structure 146 and return to knitted component 100 by entering, for example, tunnel 720 in adjacent fourth tubular structure 434, and continue in such a manner through any number of additional tubular rib structures.

In other embodiments, knitted component 100 may include tensile elements 600 in fewer tunnels or more tunnels. In one embodiment, tensile elements 600 may be disposed in tubular rib structures 126 that neighbor one another. In another embodiment, tensile elements 600 may be present in a majority of tubular rib structures 126, or in all tubular rib structures 126, of knitted component 100. In one embodiment, tensile elements 600 may be disposed in tubular rib structures 126 that are more distant from one another. In another embodiment, tensile elements 600 may occur in every other tubular structure 126, to form a staggered, or alternating, arrangement. Thus, tubular rib structures 126 that contain tensile elements 600 may be adjacent to tubular rib structures 126 that do not contain tensile elements 600. In other embodiments, the presence of tensile elements 600 may not be as regular. For example, there may be two or more tubular rib structures 126 that contain tensile elements 600, and these can be adjacent to one or more tubular rib structures 126 that do not contain tensile elements 600. Additionally, there may be one or more tubular rib structures 126 that contain tensile elements 600, and these may be adjacent to two or more tubular rib structures 126 that do not contain tensile elements 600. In other embodiments, knitted component 100 may include tensile elements 600 in one region of knitted component 100 and include no tensile elements 600 in another region of knitted component 100. In still other embodiments, knitted component 100 may include no tensile elements 600.

In different embodiments, tensile elements 600 may be formed from a variety of materials. Tensile elements 600 may comprise various materials, including rope, thread, webbing, cable, yarn, strand, filament, or chain, for example. In some embodiments, tensile elements 600 may be formed from material that may be utilized in a knitting machine or other device that forms knitted component 100. Tensile elements 600 may be a generally elongated fiber or strand exhibiting a length that is substantially greater than a width and a thickness. Accordingly, suitable materials for tensile elements 600 include various filaments, fibers, and yarns, that are formed from rayon, nylon, polyester, polyacrylic, silk, cotton, carbon, glass, aramids (e.g., para-aramid fibers and meta-aramid fibers), ultra high molecular weight polyethylene, and liquid crystal polymer. In comparison with the yarns forming the knitted component, the thickness of the tensile elements may be greater. In some configurations, the tensile element may have a significantly greater thickness than the yarns of the knitted component. Although the cross-sectional shape of a tensile element may be round, triangular, square, rectangular, elliptical, or irregular shapes may also be used. Moreover, the materials forming a tensile element may include any of the materials for the yarn within a knitted component, including, but not limited to: cotton, elastane, polyester, rayon, wool, nylon, and other suitable materials. Although tensile elements 600 may have a cross-section where width in lateral direction 104 and thickness direction 106 are substantially equal (e.g., a round or square cross-section), some tensile elements may have a width that is somewhat greater than their thickness (e.g., a rectangular, oval, or otherwise elongated cross-section).

In different embodiments, size and length of tensile elements 600 may vary. In some embodiments, tensile elements 600 may extend across the length of one or more tubular rib structures. In other embodiments, tensile elements 600 may extend only partway across the length of one or more tubular rib structures. In another embodiment, tensile elements 600 may extend beyond the length of one or more tubular rib structures. In some embodiments, first cable 702 may comprise a first length in some tubular rib structures and second cable 704 may comprise a second length in other tubular rib structures. For example, in one embodiment, first cable 702 may extend partway across the length of one or more tubular rib structures, second cable 704 may extend across the full length of another tubular structure, while third cable 706 may extend beyond the length of a tubular structure.

In different embodiments, end portions of tensile elements 600 can enter and/or exit first longitudinal ends 134 of tubular rib structures and/or second longitudinal ends 136 of tubular rib structures. Tensile elements 600 may be adjusted in tautness, length, friction, or other aspects. In some embodiments, a tensile element may be anchored at any point along its length to stabilize or inhibit the movement of the tensile element. For example, in some cases, tensile elements 600 may be anchored at one or more longitudinal ends, to prevent their ends from being pulled through one of the tubular rib structures beyond a designated point. In other cases, a single tensile element may be looped through two or more tubular rib structures, which may prevent tensile elements from being pulled into tubular rib structures beyond a certain point.

In different embodiments, resistance between tensile elements 600 and the inner surface of tubular rib structures 126 may be adjusted. Friction may be altered through various configurations of tubular rib structures 126 and/or tensile elements 600. This may permit tensile elements 600 to move through the tunnels with varying levels of tension or compression. Depending on the preferred level of stiffness, the amount of contact between tensile elements 600 and the inner surface of tubular rib structures 126 may be adjusted.

It should be understood that in different embodiments, one or more alterations may be made to webbed areas 128, tubular rib structures 126, or tensile elements 600 in order to adjust the resistance between tensile elements 600 and knitted component 100, including those described above. Some embodiments may allow other configurations. For example, in one embodiment, the diameter of a cable may be increased, while the lateral length of one or more knit layers of the tubular rib structures corresponding with the tensile element may be decreased. In another embodiment, the thickness of one or more knit layers may be decreased, and/or the diameter of the tensile element associated with those knit layers may be increased.

Figure 8:
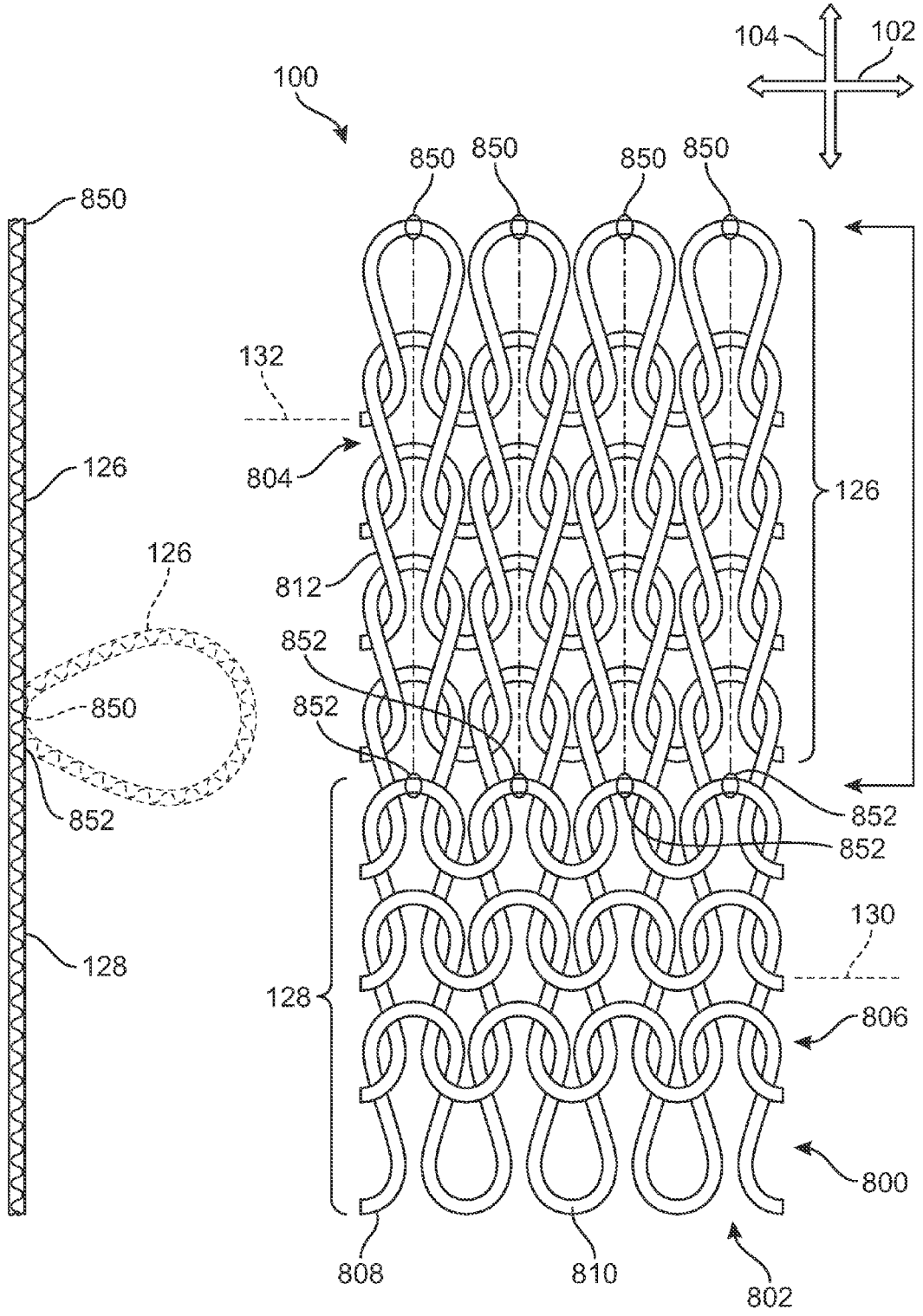
FIG. 8 is a detail view of an embodiment of the knitted component.

Referring now to FIG. 8, a portion of knitted component 100 is illustrated in detail in a flatten configuration. As shown, knitted component 100 can include one or more yarns, strands, monofilaments, compound filaments, or other strands that are knitted to define knitted component 100. A yarn 808 can be knitted and stitched to define a plurality of successive courses 800 and a plurality of successive wales 802. In some embodiments, courses 800 can extend generally in longitudinal direction 102, and wales 802 can extend generally in lateral direction 104.

A representative portion of webbed area 128 and a representative portion of a knit layer of tubular rib structure 126 are also indicated in FIG. 8. In this flattened configuration, tubular rib structure 126 is shown in a two dimensional state for purposes of illustration, the three dimensional configuration of tubular rib structure 126 is shown in phantom. As shown, the plurality of courses 800 of knitted component 100 can include a plurality of web courses 806 that define webbed area 128. Also, as shown, the plurality of courses 800 of knitted component 100 can include a plurality of tubular courses 804 that help to define tubular rib structure 126. In some embodiments, web courses 806 can extend in the same direction as web axis 130, and tubular courses 804 can extend in the same direction as tubular axis 132, also referred to in FIGS. 1 and 2.

The knitting pattern of webbed area 128 can be opposite the knitting pattern of tubular rib structure 126. For example, one or more portions of tubular rib structure 126 can be knitted using a front jersey knit pattern, and one or more portions of webbed area 128 can be knitted using a reverse jersey knit pattern. In other embodiments, tubular rib structure 126 can be knitted using a reverse jersey stitching pattern, and webbed area 128 can be knitted using a front jersey stitching pattern. It will be appreciated that the inherent biasing provided by this type of knitting pattern can at least partially cause the biased curling, rolling, folding, or compacting behavior of webbed areas 128 and tubular rib structures 126. Also, it will be appreciated that in some embodiments, webbed area 128 may be stitched in an opposite pattern from one knit layer of tubular rib structure 126.

In an exemplary embodiment, during the knitting process, at least one tubular course 804 may be joined by knitting to at least one web course 806 so as to form a loop and close tubular rib structure 126. For example, as shown in FIG. 8, a first portion 850 of one tubular course 804 forming tubular rib structure 126 may be joined by knitting to an attachment portion 852 of one web course 806. First portion 850 and attachment portion 852 may be joined by knitting with yarn across both of the front bed and back bed of the knitting machine to interloop portions of each of tubular course 804 and web course 806. With this arrangement, tubular rib structure 126 may move from a substantially flattened, two-dimensional configuration to a raised, three-dimensional configuration, as shown in FIGS. 1 through 7.

Webbed areas 128 can include any number of web courses 806, and tubular rib structures 126 can include any number of tubular courses 804. In the embodiment of FIG. 8, webbed area 128 includes four web courses 806, and the depicted knit layer of tubular structure 126 includes four tubular courses 804. However, the number of web courses 806 and tubular courses 804 can be different from the embodiment of FIG. 8. For example, in other embodiments, webbed area 128 can include five to ten web courses 806, and a single knit layer of tubular structure 126 can include five to ten tubular courses 804. Also, the curvature of webbed area 128 can be affected by the number of web courses 806 that are included, and the curvature of tubular rib structure 126 can be affected by the number of tubular courses 804 that are included. More specifically, by increasing the number of web courses 806, the width, curvature and/or stretchability of webbed areas 128 can be increased. Likewise, by increasing the number of tubular courses 804, the width and/or curvature of some or all of tubular rib structures 126 can be increased. The number of web courses 806 within webbed area 128 can be chosen to provide enough fabric to allow webbed area 128 sufficient elasticity. The number of tubular courses 804 within tubular structure 126 can be chosen to provide enough fabric to allow some or all of tubular structure 126 to sufficiently curl to form a hollow tube.

In some embodiments, yarn 808 can be made from a material or otherwise constructed to enhance the resiliency of the webbed areas 128 and tubular rib structures 126. Yarn 808 can be made out of any suitable material, such as cotton, elastane, polymeric material, or combinations of two or more materials. Also, in some embodiments, yarn 808 can be stretchable and elastic. As such, yarn 808 can be stretched considerably in length and can be biased to recover to its original, neutral length. In some embodiments, yarn 808 can stretch elastically to increase in length at least 25% from its neutral length without breaking. Furthermore, in some embodiments, yarn 808 can elastically increase in length at least 50% from its neutral length. Moreover, in some embodiments, yarn 808 can elastically increase in length at least 75% from its neutral length. Still further, in some embodiments, yarn 808 can elastically increase in length at least 100% from its neutral length. Accordingly, the elasticity of yarn 808 can enhance the overall resilience of knitted component 100.

Additionally, in some embodiments, knitted component 100 can be knitted using a plurality of different yarns. For example, in FIG. 8, at least one portion of webbed area 128 can be knitted using a first yarn 810, and at least one portion of tubular structure 126 can be knitted using a second yarn 812. In some embodiments, first yarn 810 and second yarn 812 can differ in at least one characteristic. For example, first yarn 810 and second yarn 812 can differ in appearance, diameter, denier, elasticity, texture, or other characteristic. In some embodiments, first yarn 810 and second yarn 812 can differ in color. Thus, in some embodiments, when a viewer is looking at front surface 108 when knitted component 100 is in the first position of FIGS. 1 and 4, first yarn 810 can be visible and second yarn 812 can be hidden from view. Then, when knitted component 100 stretches to the position of FIGS. 2 and 5, second yarn 812 can be revealed. Thus, the appearance of knitted component 100 can vary, and first yarn 810 and second yarn 812 can provide striking visual contrast that is aesthetically appealing.

In another embodiment, in at least some portions of knitted component 100, the elasticity of first yarn 810 is greater than the elasticity of second yarn 812. This can result in one or more portions of knitted component 100 comprising webbed areas 128 that can have a greater capacity for stretch than tubular rib structures 126.

Knitted component 100 can be manufactured using any suitable machine, implement, and technique. For example, in some embodiments, knitted component 100 can be automatically manufactured using a knitting machine, such as the knitting machine 900 shown in FIG. 9. Knitting machine 900 can be of any suitable type, such as a flat knitting machine. However, it will be appreciated that knitting machine 900 could be of another type without departing from the scope of the present disclosure.

Figure 9:
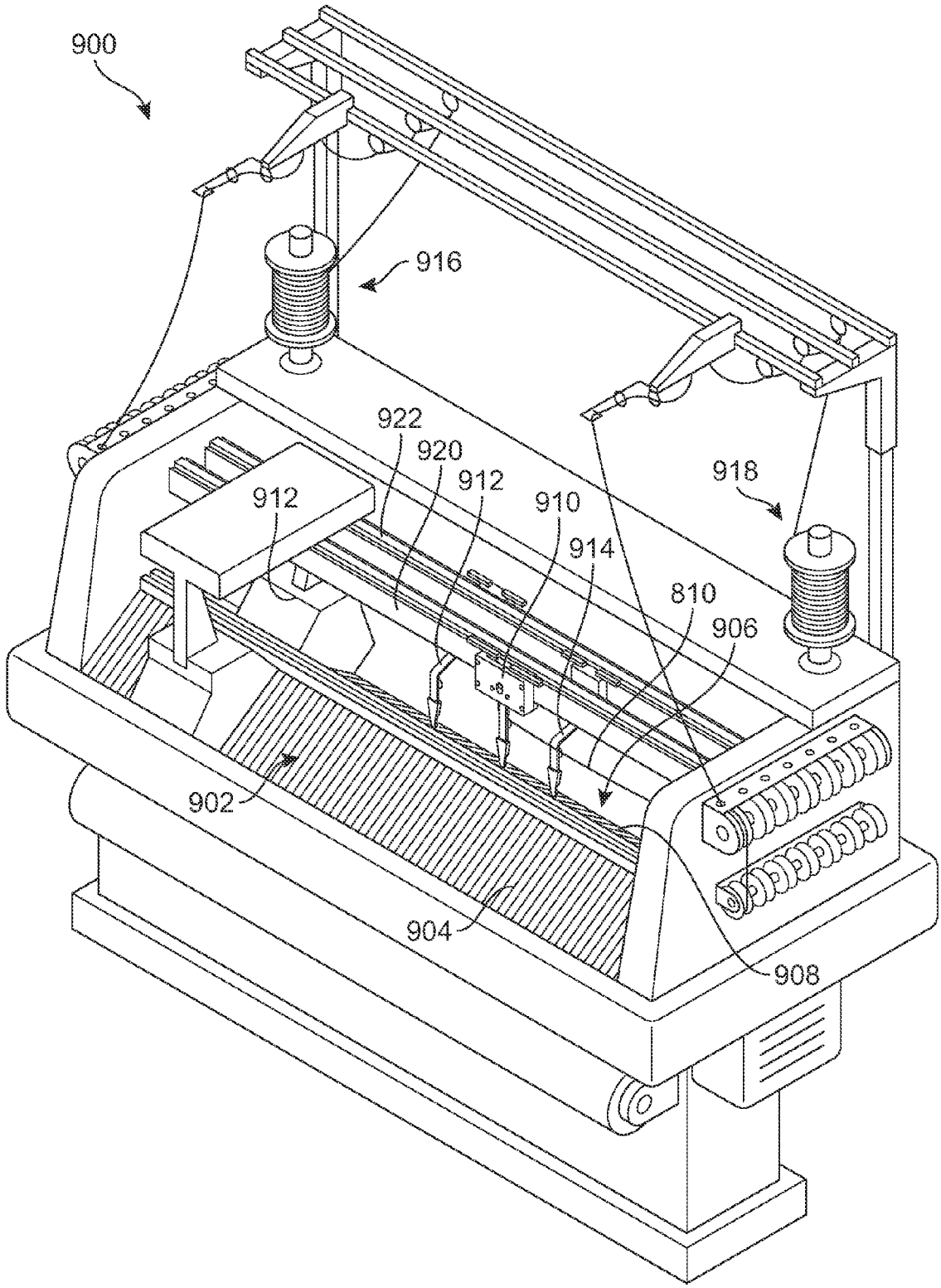
FIG. 9 is a schematic perspective view of an embodiment of a knitting machine configured for manufacturing the knitted component.

As shown in the embodiment of FIG. 9, knitting machine 900 can include a front needle bed 902 with a plurality of front needles 904 and a rear needle bed 906 with a plurality of rear needles 908. Front needles 904 can be arranged in a common plane, and rear needles 908 can be arranged in a different common plane that intersects the plane of front needles 904. Front needle bed 902 and rear needle bed 906 may be angled with respect to each other. In some embodiments, front needle bed 902 and rear needle bed 906 may be angled so they form a V-bed. Knitting machine 900 can further include one or more feeders that are configured to move over front needle bed 902 and rear needle bed 906. In FIG. 9, a first feeder 910 and a second feeder 912 are indicated. As first feeder 910 moves, first feeder 910 can deliver first yarn 810 to front needles 904 and/or rear needles 908 for knitting knitted component 100. As second feeder 912 moves, second feeder 912 can deliver second yarn 812 to front needles 904 and/or rear needles 908.

A pair of rails, including a forward rail 920 and a rear rail 922, may extend above and parallel to the intersection of front needle bed 902 and rear needle bed 906. Rails may provide attachment points for feeders. Forward rail 920 and rear rail 922 may each have two sides, each of which accommodates one or more feeders. As depicted, forward rail 920 includes first feeder 910 and second feeder 912 on opposite sides, and rear rail 922 includes third feeder 914. Although two rails are depicted, further configurations of knitting machine 900 may incorporate additional rails to provide attachment points for more feeders.

Feeders can move along forward rail 920 and rear rail 922, thereby supplying yarns to needles. As shown in FIG. 9, yarns are provided to a feeder by a first spool 916 and/or a second spool 918. More particularly, first yarn 810 extends from first spool 916 to first feeder 910, and second yarn 812 extends from second spool 918 to second feeder 912. Although not depicted, additional spools may be used to provide yarns to feeders in a substantially similar manner as first spool 916 and second spool 918.

In some embodiments, webbed areas 128 can be formed using either front needles 904 of front needle bed 902 or rear needles 908 of rear needle bed 906. Tubular rib structures can be formed using the needles of both front needle bed 902 and rear needle bed 906.

Figure 10A:
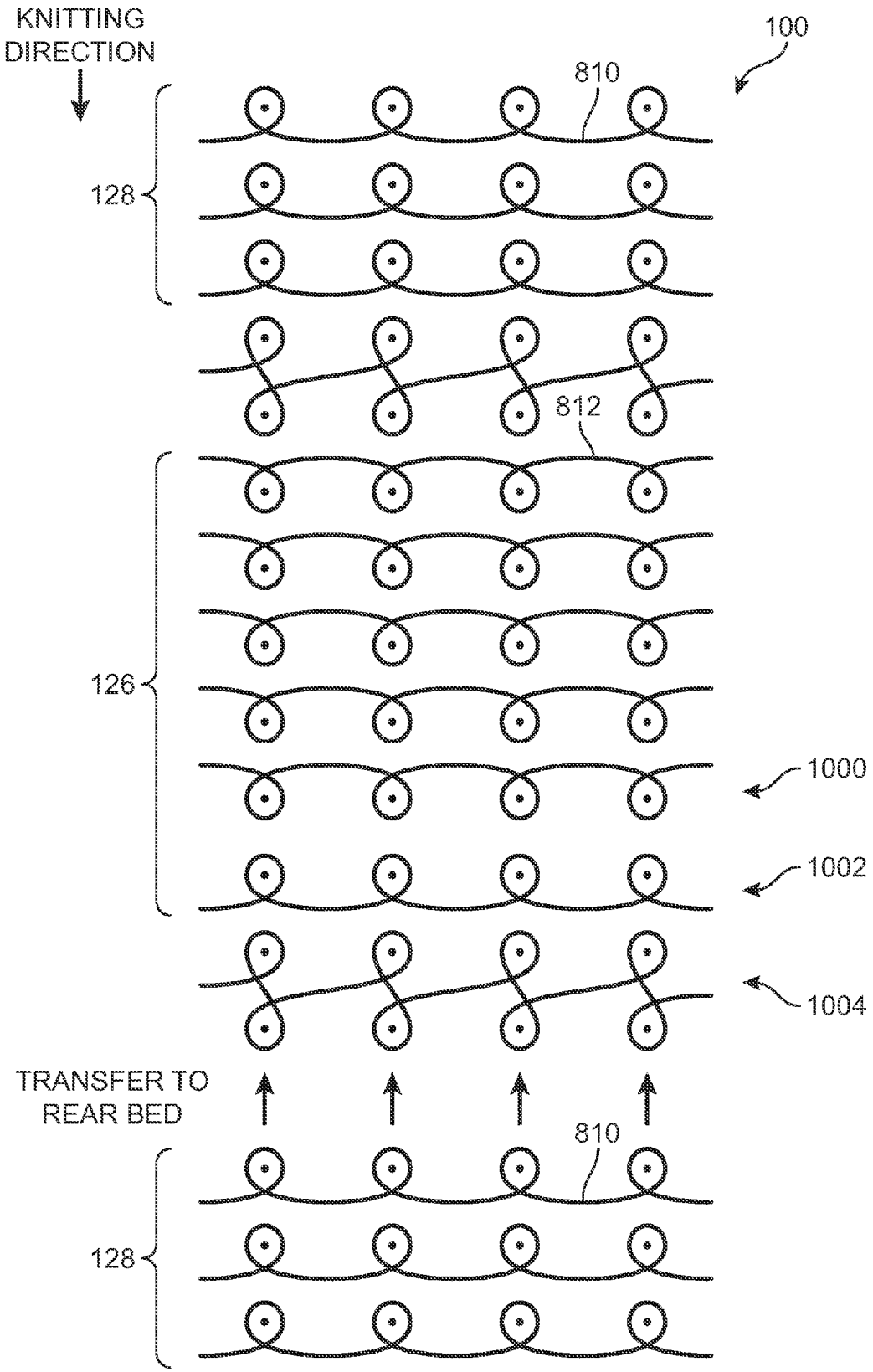
FIG. 10A is a schematic knitting diagram of an embodiment of the knitted component of FIG. 1.
Figure 10B:
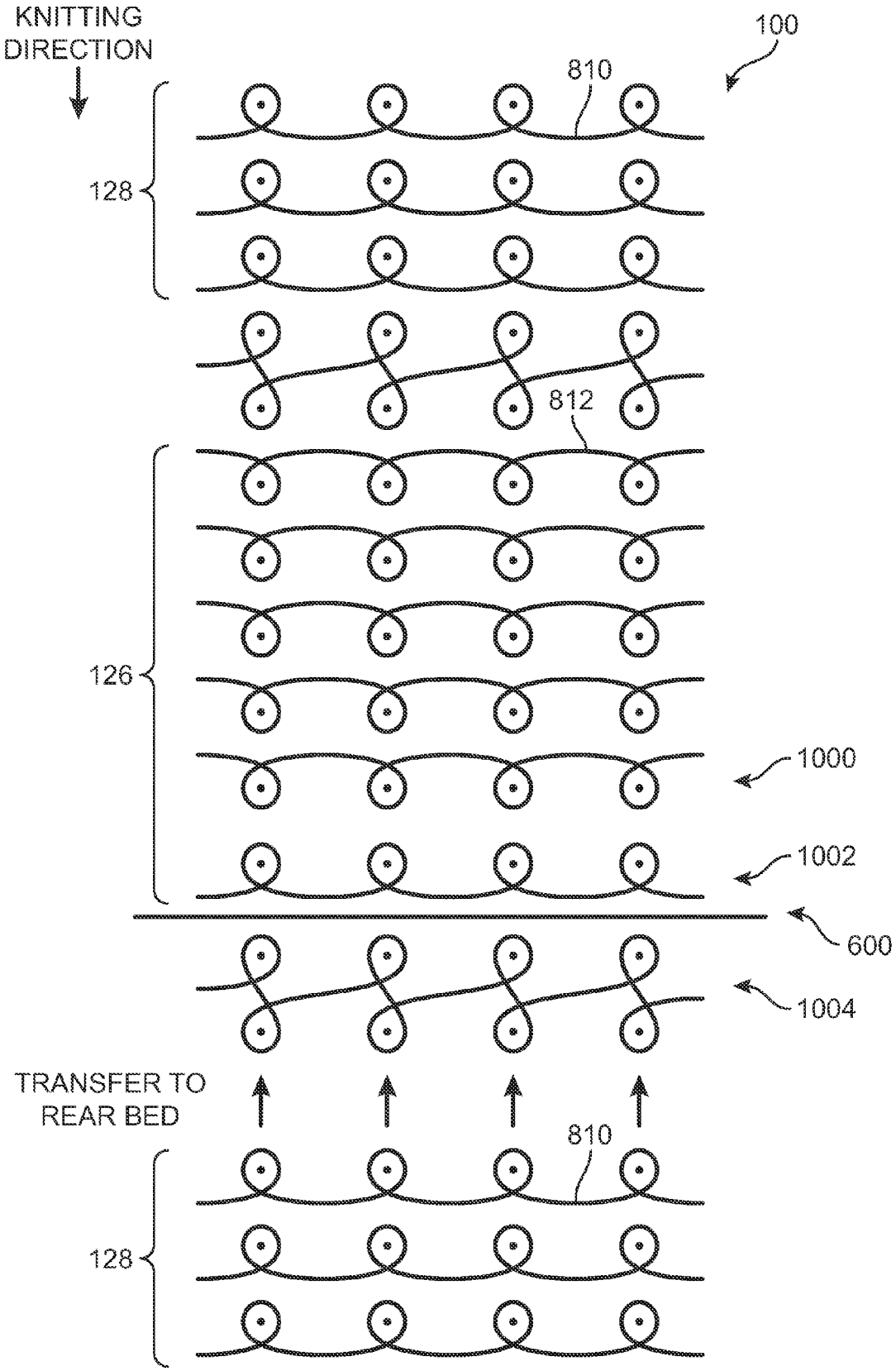
FIG. 10B is a schematic knitting diagram of an embodiment of the knitted component of FIG. 1 including an inlaid tensile element.

In some embodiments, an exemplary process for knitting a tubular rib structure between successive webbed areas 128 may be performed using knitting machine 900. FIGS. 10A and 10B illustrate representative knitting diagrams or looping diagrams of an exemplary knitting process for forming a tubular rib structure, for example, tubular rib structure 126 of knitted component 100. In one embodiment, represented in FIG. 10A, webbed area 128 can be formed from first yarn 810 using rear needle bed 906, followed by tubular rib structure 126 being formed from second yarn 812 using rear needle bed 906 and front needle bed 902, and another webbed area 128 being formed from first yarn 810 using rear needle bed 906. The following discussion describes the knitting process schematically illustrated in FIGS. 10A-10B, and it will be understood that the front needle bed 902 and rear needle bed 906 referred to in this discussion are shown schematically in FIG. 9.

Referring again to FIG. 10A, after formation of webbed area 128, a course may be formed extending between rear needle bed 906 and front needle bed 902. Next, one or more courses may be knit on the front needle bed 902. For example, courses forming the first curved portion of tubular rib structure 126 can be formed using second yarn 812 on front needle bed 902. Next, after a final course 1000 on front needle bed 902, second yarn 812 forming tubular rib structure 126 may be used to knit a course 1002 with rear needle bed 906. For example, course 1002 may form the second curved portion of tubular rib structure 126 that closes tubular rib structure 126 and forms a hollow tunnel. After course 1002 completes the formation of tubular rib structure 126, another course 1004 may be formed extending between rear needle bed 906 and front needle bed 902 that is interlooped to the previous final course 1000 on the front needle bed 902 and course 1002 on rear needle bed 906. By using a stitch at course 1004 that extends between rear needle bed 906 and front needle bed 902, second yarn 812 forming tubular rib structure 126 can be prepared to be associated with additional courses forming another webbed area 128 with first yarn 810 using rear needle bed 906.

In this embodiment, tubular rib structure 126 may be formed using one course knit on rear needle bed 906 and five courses knit on front needle bed 902. With this configuration, the elongated cylindrical shape of tubular rib structure 126 may be provided.

In other embodiments, different numbers of courses may be knit on one or both of front needle bed 902 and rear needle bed 906 so as to change the shape and/or size of the tubular rib structure 126. In some cases, by increasing or decreasing the number of courses knit on the rear needle bed 906 and/or front needle bed 902 the size of the tubular rib structure 126 may be correspondingly enlarged or reduced. In other cases, by increasing the number of courses knit on one of the rear needle bed 906 or front needle bed 902 relative to the other, the shape of the tubular rib structure 126 may be altered. For example, by increasing the number of courses knit on the rear needle bed 906, the shape of tubular rib structure 126 may be changed so as to round out the curvature on the back surface 110 of knitted component 100 to be similar to the curvature on the front surface 108 of knitted component 100.

After the completion of tubular rib structure 126, the process may then repeat to form another webbed area 128. Subsequently, an additional webbed area 128 can be added to knitted component 100 using rear needle bed 906, and so on until a completed knitted component 100 is formed having the desired number of webbed areas 128 and tubular rib structures 126.

In other embodiments, the formation of knitted component 100 may be similar but entail a switch in the needle beds used. For example, the process shown in FIGS. 10A and 10B may be performed using opposite needle beds, such that webbed area 128 can be formed using front needle bed 902 and then the portion of knitted component 100 can be transferred from front needle bed 902 to rear needle bed 906. The remaining steps shown in FIGS. 10A and 10B can be performed in identical order using the opposite needle bed than illustrated. Other methods of using the various needle beds of knitting machine 900 to form webbed areas 128 and tubular rib structures 126 will be apparent to one of ordinary skill in the art based on the above description.

In the exemplary process described in reference to FIG. 10A, a hollow tubular rib structure 126 is formed. In other embodiments, a tensile element may be inlaid within the unsecured central area of one or more tubular rib structures 126. FIG. 10B illustrates an exemplary process for forming tubular rib structure 126 including an inlaid tensile element. As shown in FIG. 10B, the process is substantially similar as the process for forming hollow tubular rib structure 126 illustrated in FIG. 10A. However, in the process of FIG. 10B, after forming course 1002 on rear needle bed 906, tensile element 600 is inlaid within a portion of tubular rib structure 126. Tensile element 600 may be inlaid using a combination feeder and associated method of inlaying described in U.S. Patent Application Publication No. 2012/0234052, the disclosure of which application is incorporated herein in its entirety.

After tensile element 600 is inlaid within the portion of tubular rib structure 126, an additional course 1004 may be knit using second yarn 812 to complete the formation of tubular rib structure 126. With this configuration, tensile element 600 is contained within tubular rib structure 126 and is disposed through the unsecured central area running along the length of tubular rib structure 126.

FIGS. 11-17 further illustrate the process of knitting a knitted component 1100 having a plurality of webbed areas and a plurality of tubular rib structures. FIGS. 11-17 are merely exemplary representative illustrations of the process used to knit the various portions of knitted component 1100. Additional steps or processes not shown here may be used to form a completed knitted component that is to be incorporated into an upper for an article of footwear. In addition, only a relatively small section of a knitted component 1100 may be shown in the Figures in order to better illustrate the knit structure of the various portions of knitted component 1100. Moreover, the scale or proportions of the various elements of knitting machine 900 and knitted component 1100 may be enhanced to better illustrate the knitting process.

It should be understood that although knitted component 1100 is formed between front needle bed 902 and rear needle bed 906, for purposes of illustration, in FIGS. 11 through 17, knitted component 1100 is shown adjacent to front needle bed 902 and rear needle bed 906 to (a) be more visible during discussion of the knitting process and (b) show the position of portions of the knitted component relative to each other and needle beds. The front needles and rear needles are not depicted in FIGS. 11-17 for purposes of clarity. Also, although one rail, and limited numbers of feeders are depicted, additional rails, feeders, and spools may be used. Accordingly, the general structure of knitting machine 900 is simplified for purposes of explaining the knitting process.

Figure 11:
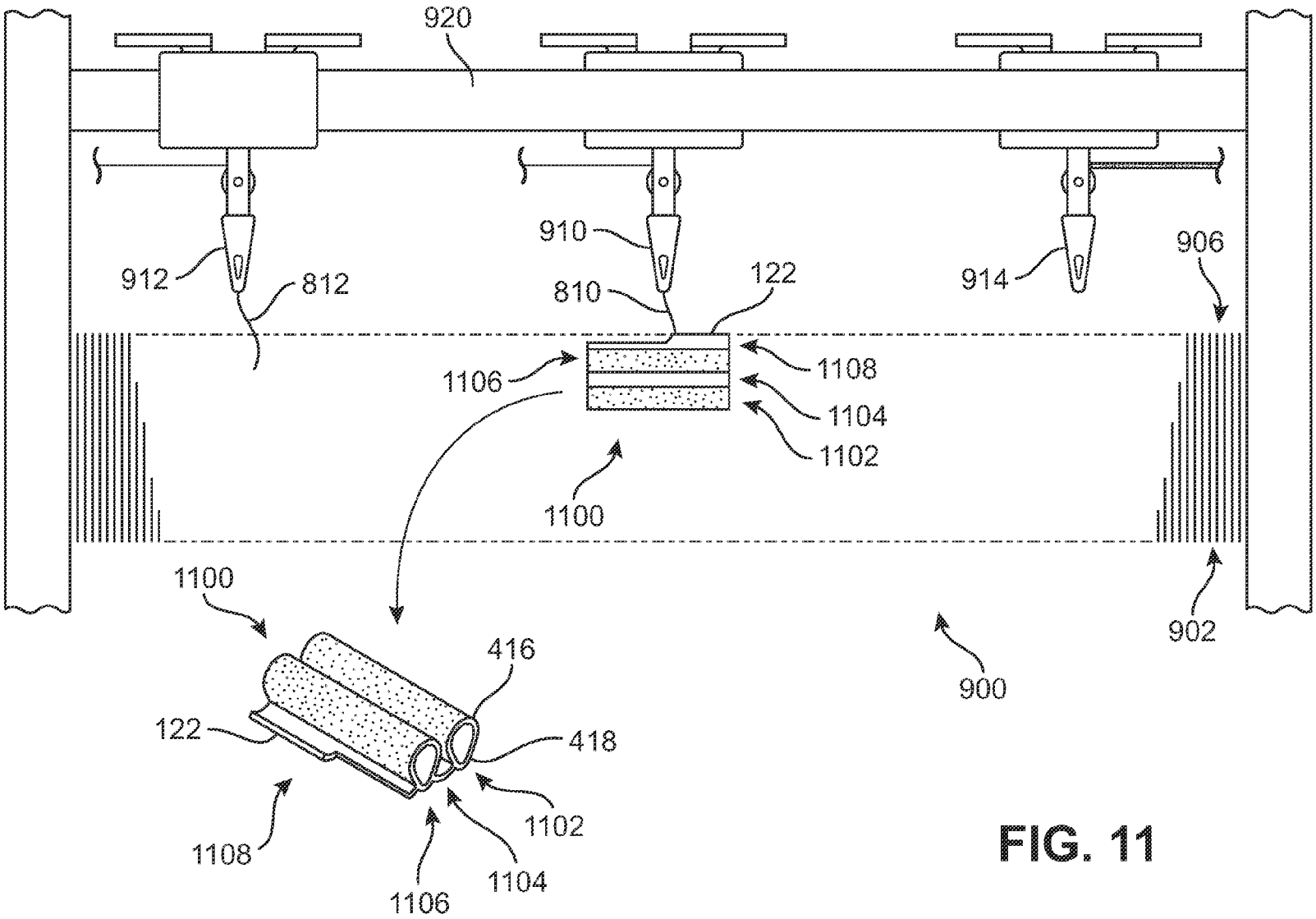
FIG. 11 is a schematic illustration of an embodiment of a method of manufacturing an embodiment of the knitted component, wherein a webbed area is shown being formed.

Referring to FIG. 11, a portion of knitting machine 900 is shown. In this embodiment, knitting machine 900 may include a first feeder 910 and a second feeder 912. In other embodiments, additional feeders may be used and may be located on the front or rear side of forward rail 920 and/or rear rail 922.

In FIG. 11, first yarn 810 from a spool (not shown) passes through first feeder 910 and an end of first yarn 810 extends outward from a dispensing tip at the end of first feeder 910. Any type of yarn (e.g., filament, thread, rope, webbing, cable, chain, or strand) may pass through first feeder 910. Second yarn 812 similarly passes through second feeder 912 and extends outward from a dispensing tip. In some embodiments, first yarn 810 and second yarn 812 may be used to form portions of knitted component 1100.

In different embodiments, the knitting process may begin with formation of either a webbed area or a tubular rib structure. Each webbed area or tubular rib structure may be referred to as a section of knitted component 1100. Completion of one webbed area or tubular rib structure may be followed by formation of a second webbed area or tubular rib structure. Multiple sections of knitted component 1100 may be formed in an alternating manner between webbed areas and tubular rib structures. This knitting process may continue until knitted component 1100 is fully formed.

In the embodiment of FIG. 11, three sections of knitted component 1100 have been formed by knitting machine 900, including a first tubular structure 1102, a first webbed area 1104, and a second tubular structure 1106. Additionally, formation of a second webbed area 1108 is proceeding on knitting machine 900. As described earlier, webbed areas may be knit by either the front needle bed 902 or the rear needle bed 906 of knitting machine 900. First feeder 910 is positioned along an unfinished fourth edge 122 of knitted component 1100. First feeder 910 may feed first yarn 810 to either front needle bed 902 or rear needle bed 906. Front needle bed 902 or rear needle bed 906 can receive first yarn 810 and form loops that define the courses of second webbed area 1108. Below the machine in the illustration, knitted component 1100, as it is being formed, is depicted in an isometric view.

Figure 12:
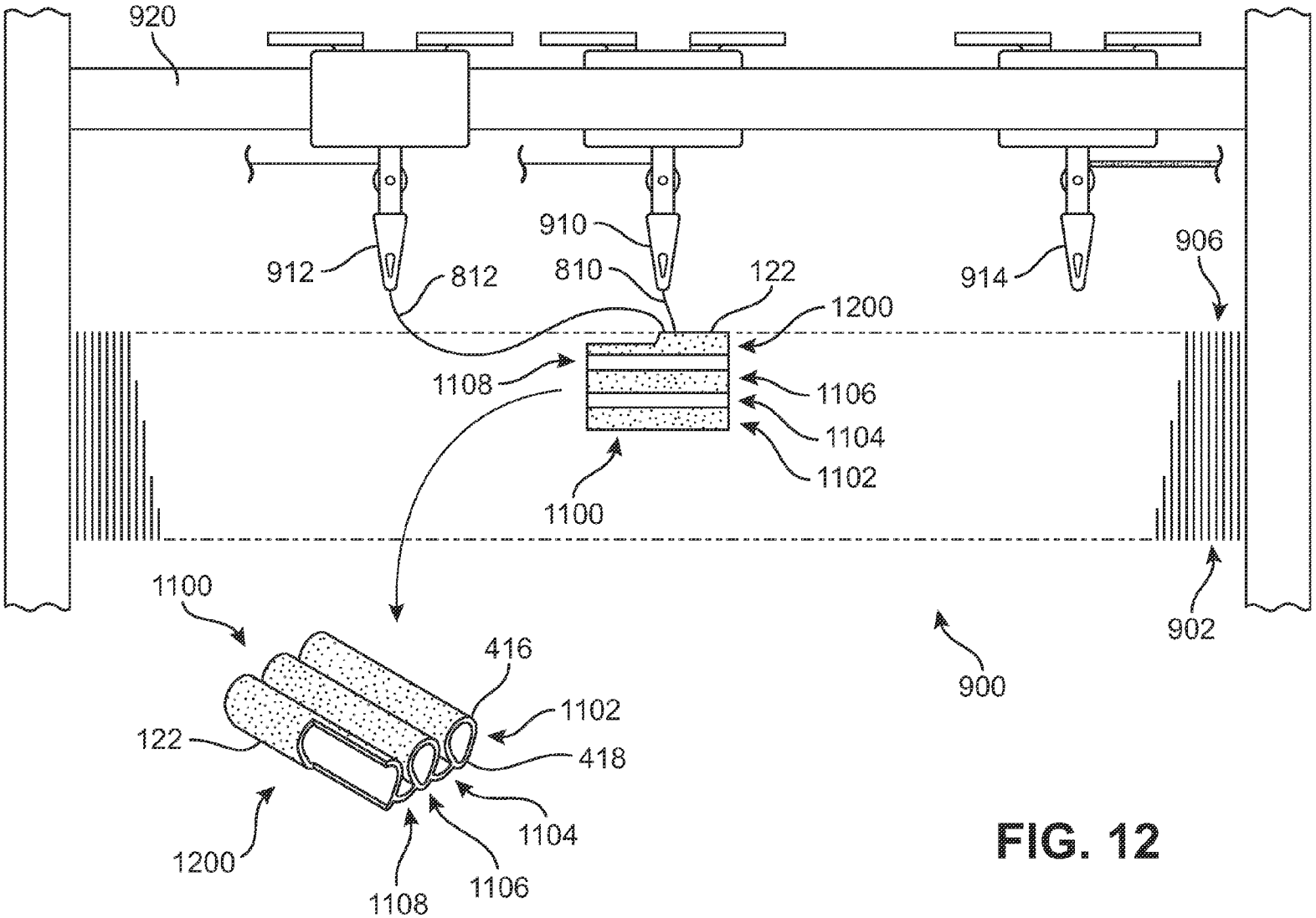
FIG. 12 is a schematic illustration of an embodiment of a method of manufacturing an embodiment of the knitted component, wherein a tubular structure is shown being formed.

In the subsequent illustration of FIG. 12, four sections of knitted component 1100 have been formed by knitting machine 900, including first tubular rib structure 1102, first webbed area 1104, second tubular rib structure 1106, and second webbed area 1108. Formation of a third tubular rib structure 1200 is proceeding on knitting machine 900. As described earlier, tubular rib structures may be knit by both the front needle bed 902 and the rear needle bed 906 of knitting machine 900. First feeder 910 and second feeder 912 are positioned near unfinished fourth edge 122 of knitted component 1100. First feeder 910 may feed first yarn 810 to either front needle bed 902 or rear needle bed 906. In some embodiments, front needle bed 902 can receive first yarn 810 and form loops that define the courses forming first curved portion 416 of third tubular rib structure 1200. In other embodiments, rear needle bed 906 can receive first yarn 810 and form loops that define courses of first curved portion 416 of third tubular rib structure 1200. Below the machine in the illustration, knitted component 1100 is depicted in an isometric view as it is being formed.

In different embodiments, the various areas of tubular rib structures may be formed by different elements of knitting machine 900. In an exemplary embodiment, first curved portion 416 may be formed by front needle bed 902, and second curved portion 418 may be formed by rear needle bed 906, so that first feeder 910 feeds first yarn 810 to front needle bed 902, and second feeder 912 feeds second yarn 812 to rear needle bed 906. In another embodiment, first curved portion 416 may be formed by rear needle bed 906, and second curved portion 418 may be formed by front needle bed 902, so that first feeder 910 feeds first yarn 810 to rear needle bed 906, and second feeder 912 feeds second yarn 812 to front needle bed 902.

Figure 13:
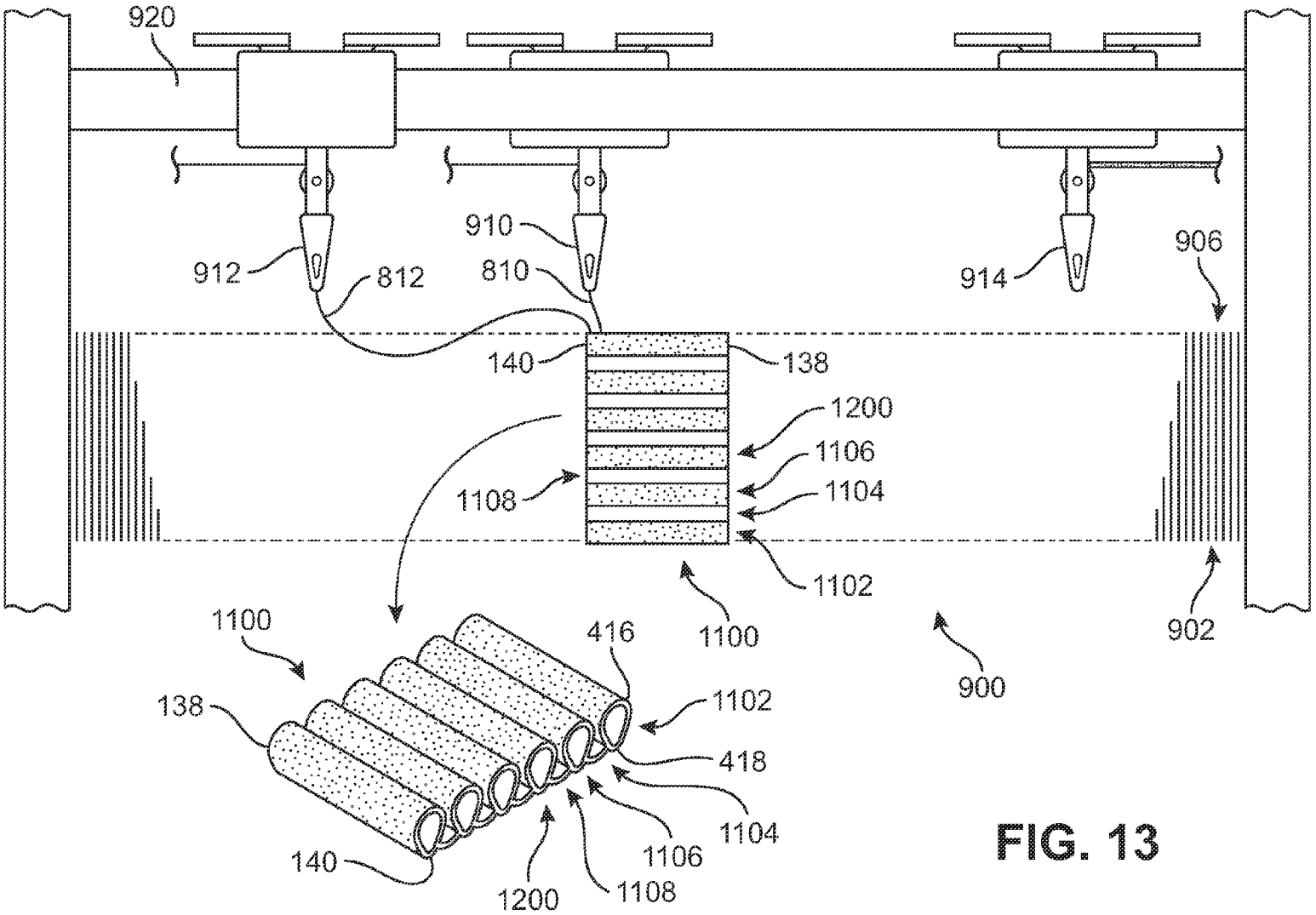
FIG. 13 is a schematic illustration of an embodiment of a method of manufacturing an embodiment of the knitted component, wherein webbed areas and tubular rib structures have been added.

FIG. 13 depicts the formation of a knitted component 1100 with eleven sections, including six tubular rib structures and five webbed areas. In an exemplary embodiment, each webbed area is disposed between two adjacent tubular rib structures on either side of the webbed area. The knitting process can be continued and the desired amount of webbed areas and tubular rib structures can be formed until knitted component 1100 is complete with the desired dimensions. Additionally, other known knitting processes and methods may be used to form various other portions of knitted component 1100.

Figure 14:
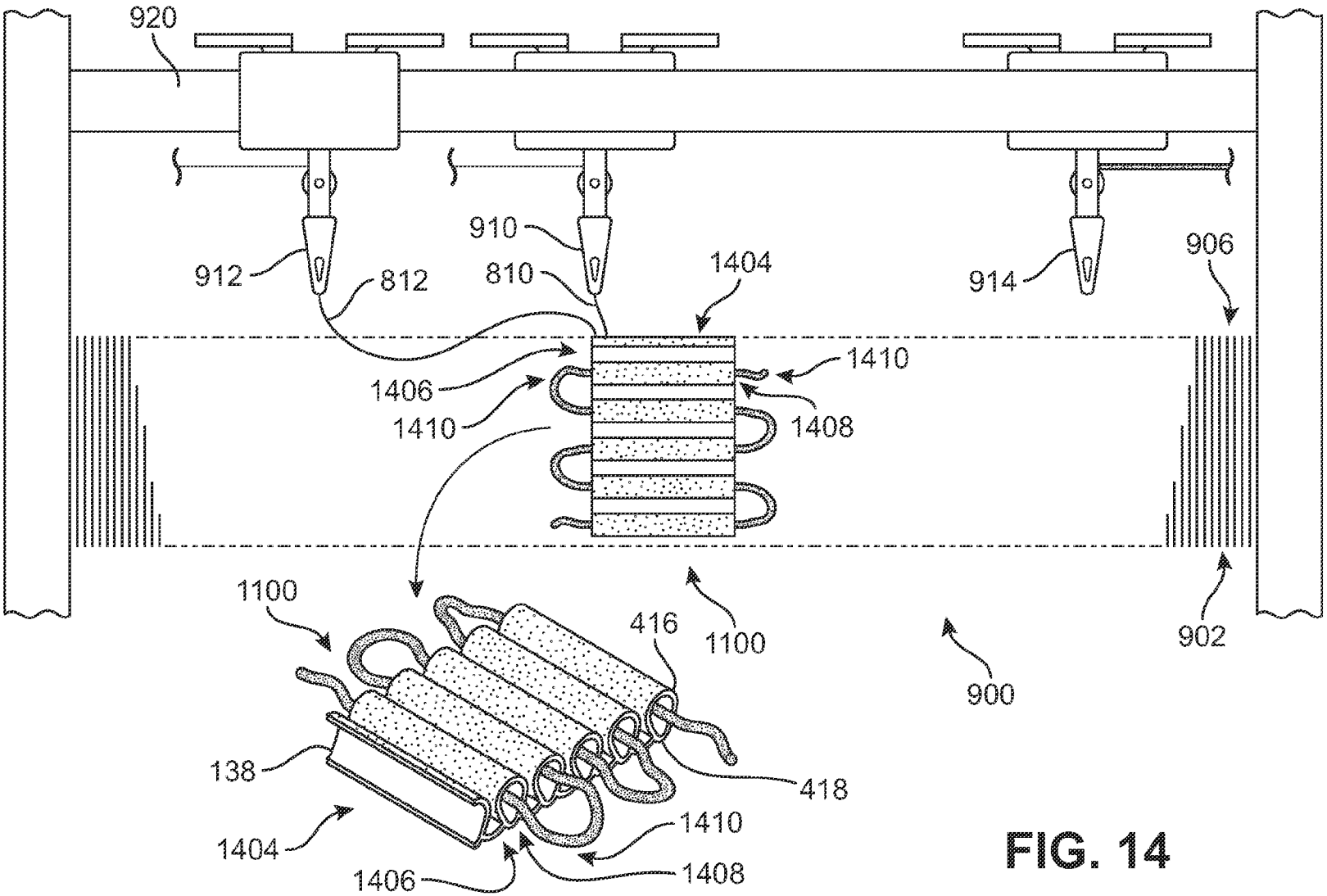
FIG. 14 is a schematic illustration of an embodiment of a method of manufacturing an embodiment of the knitted component that includes tensile elements, wherein a tubular structure is being formed.

In different embodiments, a knitting process may include the incorporation of one or more tensile elements within portions of knitted component 1100. Referring to FIGS. 14-17, an embodiment of a knitted component 1100 including tensile elements is depicted. In FIG. 14, knitted component 1100 has been formed with eleven sections, including five completed tubular rib structures, five webbed areas, and a partially formed sixth tubular rib structure. Each completed tubular rib structure in this illustration can be seen including a tensile element extending through the hollow central unsecured area of the tubular rib structure. As described earlier, it should be understood that there may be various tensile element arrangements included in knitted component 1100. For example, in some embodiments, tensile elements may be disposed through a selected number of the total number of tubular rib structures associated with a knitted component. With this arrangement, additional support and resistance to stretch may be selectively provided by the desired placement of tensile elements within the tubular rib structures.

Referring again to FIG. 14, formation of a sixth tubular rib structure 1404 is underway. As described earlier, tubular rib structures may be knit by both the front needle bed 902 and the rear needle bed 906 of knitting machine 900. First feeder 910 and second feeder 912 are positioned along unfinished fourth edge 122 of knitted component 1100. Second feeder 912 may feed second yarn 812 to either front needle bed 902 or rear needle bed 906. In some embodiments, front needle bed 902 can receive second yarn 812 and form loops that define first curved portion 416 of sixth tubular rib structure 1404. In other embodiments, rear needle bed 906 can receive second yarn 812 and form loops that define first curved portion 416 of sixth tubular rib structure 1404.

Specifically, in one embodiment, first curved portion 416 may be formed by front needle bed 902, and second curved portion 418 may be formed by rear needle bed 906 so that second feeder 912 supplies second yarn 812 to front needle bed 902, and second feeder 912 also supplies second yarn 812 to rear needle bed 906. It should be understood that the choice of needle bed, feeder, and/or yarn used to form each portion of knitted component 1100 may be varied. For example, in another embodiment, the portions of sixth tubular rib structure 1404 may be formed using opposite needle beds, as described above, so that first curved portion 416 may be formed by rear needle bed 906, and second curved portion 418 may be formed by front needle bed 902. Additionally, in other embodiments, the same yarn that is used to form webbed areas may similarly be used to form tubular rib structures, so that first feeder 910 supplies first yarn 810 to front needle bed 902 and rear needle bed 906 to use in forming sixth tubular rib structure 1404. Below knitting machine 900, knitted component 1100 as it is being formed is depicted in an isometric view.

Figure 15:
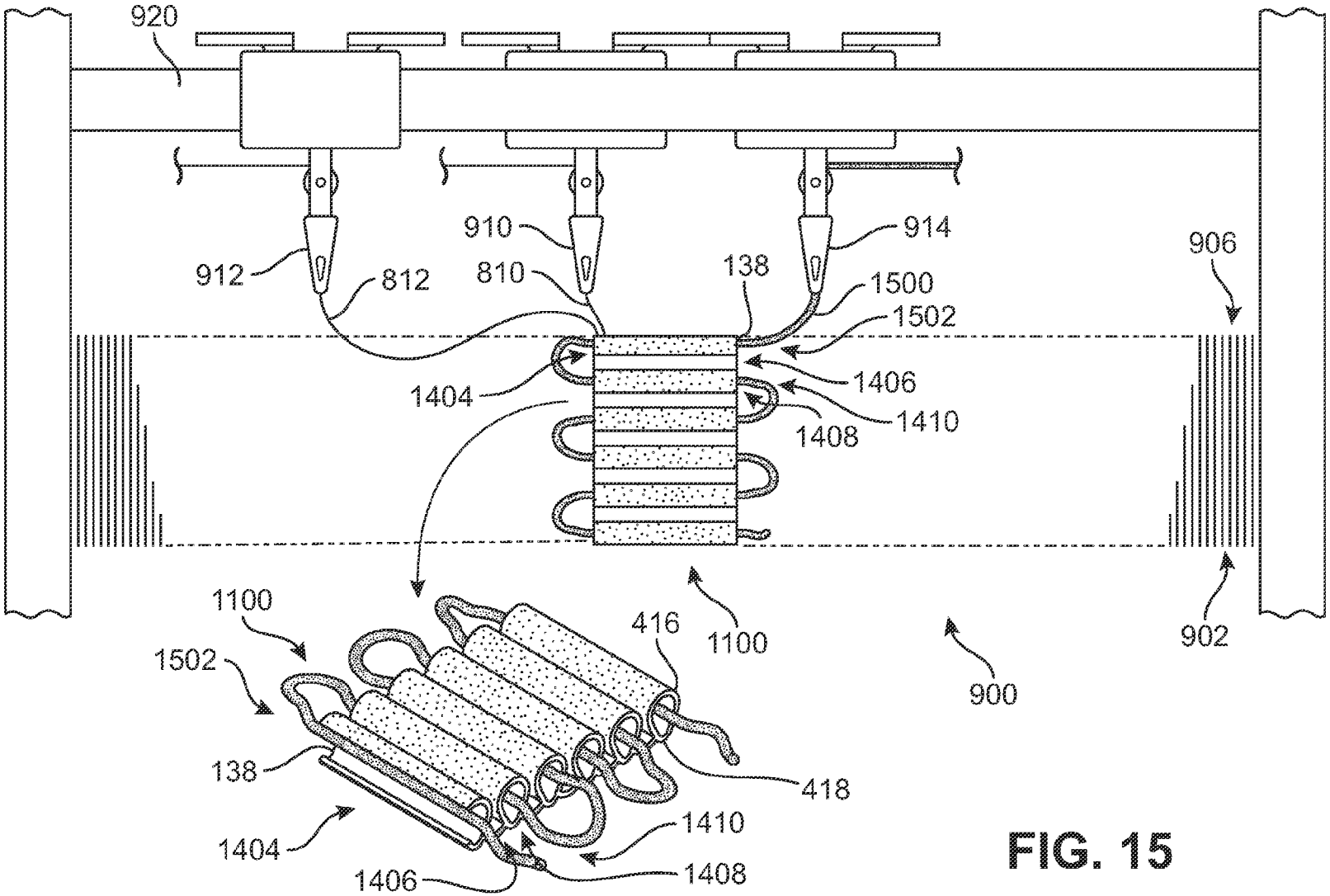
FIG. 15 is a schematic illustration of an embodiment of a method of manufacturing an embodiment of the knitted component that includes tensile elements, wherein a tubular structure is being formed and a cable is being incorporated in the tubular structure.

First feeder 910 and second feeder 912 can be returned to a start position along fourth edge 122 of knitted component 1100 to begin the next course forming a portion of sixth tubular rib structure 1404. Following this step, third feeder 914 supplies a tensile element 1500 to be inlaid within knitted component 1100, as shown in FIG. 15. In some embodiments, third feeder 914 may move along forward rail 920 or rear rail 922 as it supplies and inlays tensile element 1500 along the length of sixth tubular rib structure 1404. In different embodiments, first curved portion 416 and/or second curved portion 418 of sixth tubular rib structure 1404 may continue to be formed as tensile element 1500 is inlaid along inner surface of sixth tubular rib structure 1404. In FIG. 15, tensile element 1500 has been inlaid along the length of sixth tubular rib structure 1404.

Figure 16:
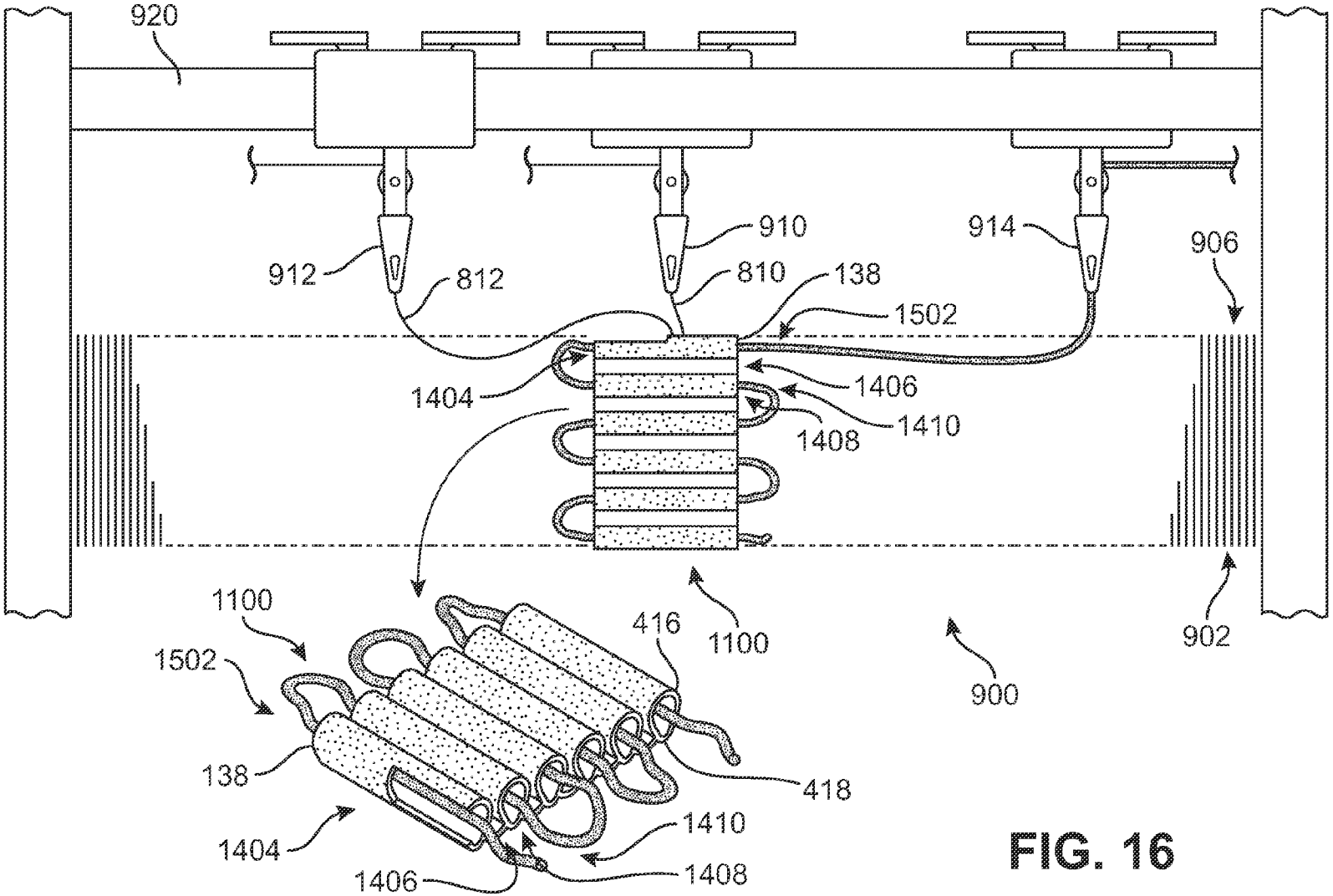
FIG. 16 is a schematic illustration of an embodiment of a method of manufacturing an embodiment of the knitted component that includes tensile elements, wherein a tubular structure is being formed.
Figure 17:
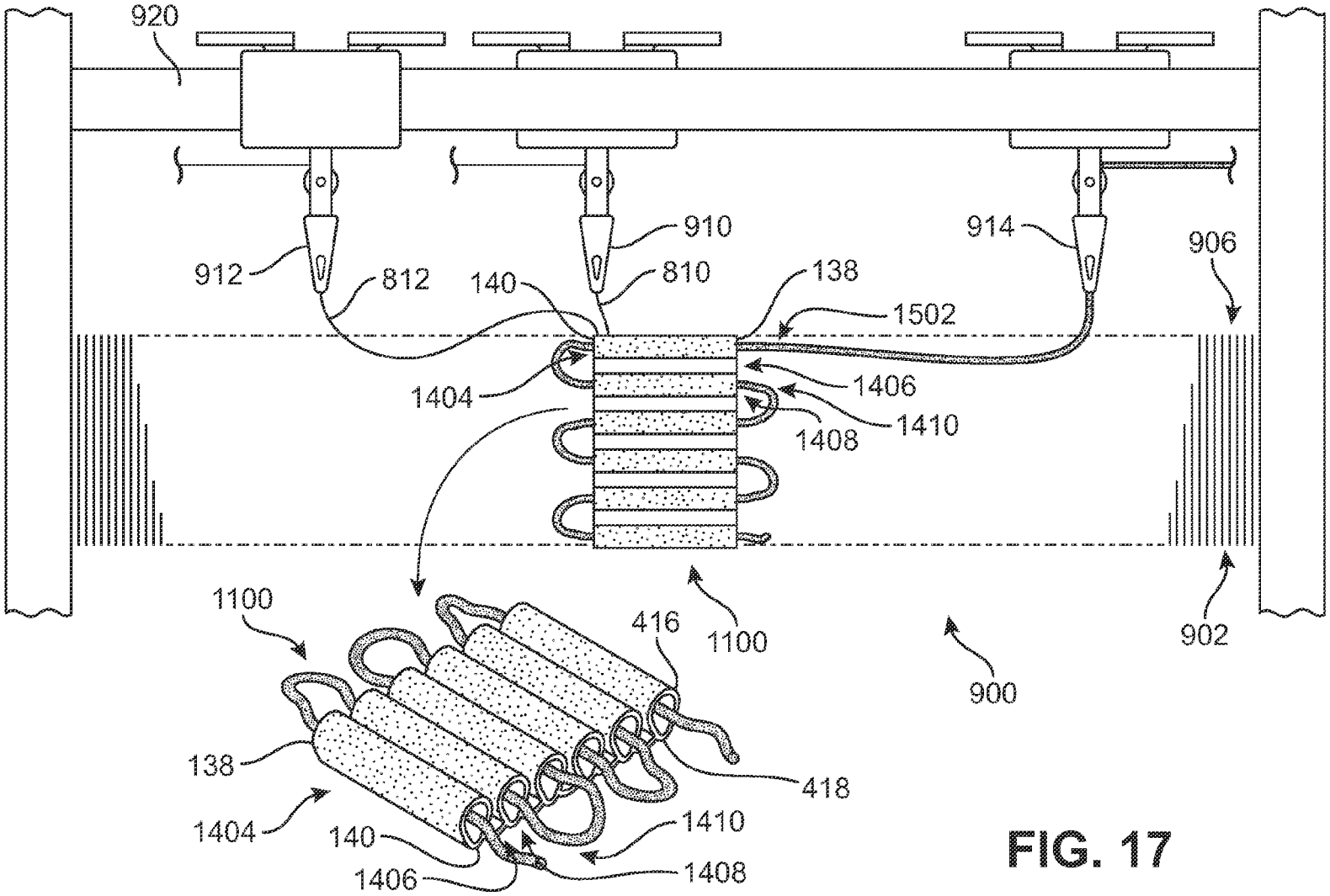
FIG. 17 is a schematic illustration of an embodiment of a method of manufacturing an embodiment of the knitted component that includes tensile elements, wherein tubular rib structures and webbed areas have been added.

First feeder 910 and second feeder 912 may begin another course forming a portion of sixth tubular rib structure 1404 in some embodiments. In FIG. 16, sixth tubular rib structure 1404 is being completed by further courses to fully form sixth tubular rib structure 1404 and thereby enclose tensile element 1500 within the interior of the hollow unsecured central area of sixth tubular rib structure 1404. FIG. 17 depicts the formation of knitted component 1100 comprising six tubular rib structures including tensile elements separated by five webbed areas between each successive tubular rib structure. Additionally, it should be understood that tubular rib structures that do not include tensile elements may also be included. This process can be continued and the desired amount of webbed areas and tubular rib structures with or without tensile elements can be formed until knitted component 1100 is complete.

Using this exemplary process for forming knitted components, manufacture of knitted component 1100 can be efficient. Also, knitted component 1100 can be substantially formed without having to form a significant amount of waste material.

Figure 19:
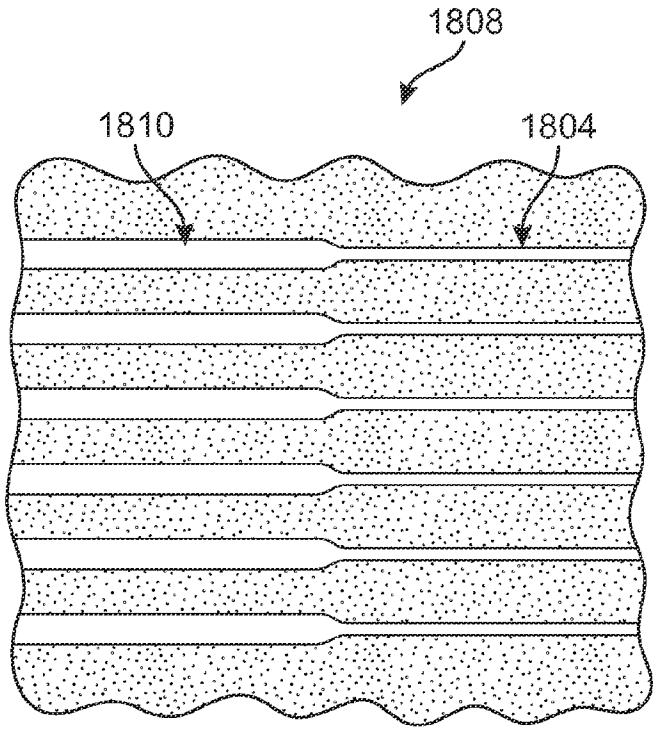
FIG. 19 is an embodiment of the knitted component in a second position.
Figure 18:
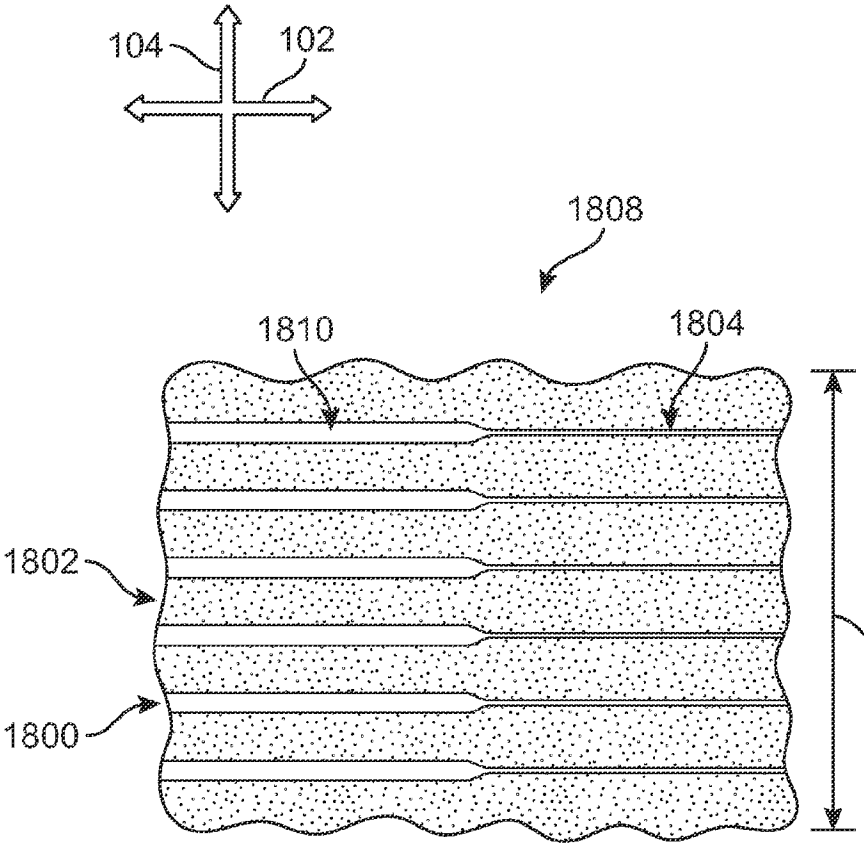
FIG. 18 is an embodiment of the knitted component in a first position.

As discussed earlier, in different embodiments, one or more webbed areas and/or tubular rib structures can move away from a compacted or neutral position toward a more extended or stretched position. FIGS. 18 and 19 depict how a compression load or force may deform one area of an embodiment of a knitted component 1808. As described previously, under the influence of a compression load, ribbed features, i.e., a series of alternating webbed areas and tubular rib structures, can move away from a compacted position, seen in FIG. 18, toward a more extended position, seen in FIG. 19. In some embodiments, upon removal or reduction of the compression load, the ribbed features can recover and return to the compacted position. It will be appreciated that knitted component 1808 can cushion, attenuate, or otherwise reduce the compression load as a result of this resilience.

In FIG. 18, a portion of an embodiment of knitted component 1808 is shown in a neutral position, similar to the embodiment of FIG. 1. Several tubular rib structures 1802 and webbed areas 1800 are shown. Knitted component 1808 is at a first width 1806. In FIG. 19, the same webbed areas 1800 and tubular rib structures 1802 are shown as they respond to a compressive load, and knitted component is stretched to a second width 1900, similar to FIG. 2. First width 1806 is less than second width 1900. In some embodiments, webbed areas 1800 may exhibit greater stretching than tubular rib structures 1802. In one embodiment, depending on the amount of force applied, and the location of the force application, some areas of knitted component 1808 may stretch further than other areas. In FIG. 19, there is greater stretch in lateral direction 104 than longitudinal direction 102.

Moreover, in some embodiments, ribbed features can differ in size, structure, shape, and other characteristic along different areas of knitted component 1808. For example, in the embodiments of FIGS. 18 and 19, different widths of webbed areas are depicted in knitted component 1808, including a first width 1810 and a second width 1804. First width 1810 is larger than second width 1804. The width of each webbed area may be determined during the knitting process by changing the number of courses that are knit for each webbed area. For example, in embodiments where first width 1810 is larger than second width 1804, the larger width of the webbed area may be due to a larger number of courses forming the webbed area having first width 1810. Similarly, a smaller width of the webbed area may be due to a smaller number of courses forming the webbed area having second width 1804. In other embodiments, the width of webbed areas 1800 and/or tubular rib structures 1802 can vary across knitted component 1808. As the size of ribbed features increase or decrease, the stretch and resilience available in knitted component 1808 can be altered. For example, areas with webbed areas 1800 comprising greater width (for example, first width 1810) may be more elastic and permit further stretch relative to webbed areas 1800 of smaller width (for example, second width 1804).

A knitted component can define and/or can be included in any suitable article. Knitted components can provide resilience to an article. As such, an article can be at least partially stretchable and elastic in some embodiments. In addition, an article can provide cushioning for the user due to the inclusion of one or more knitted component pieces.

Figure 20:
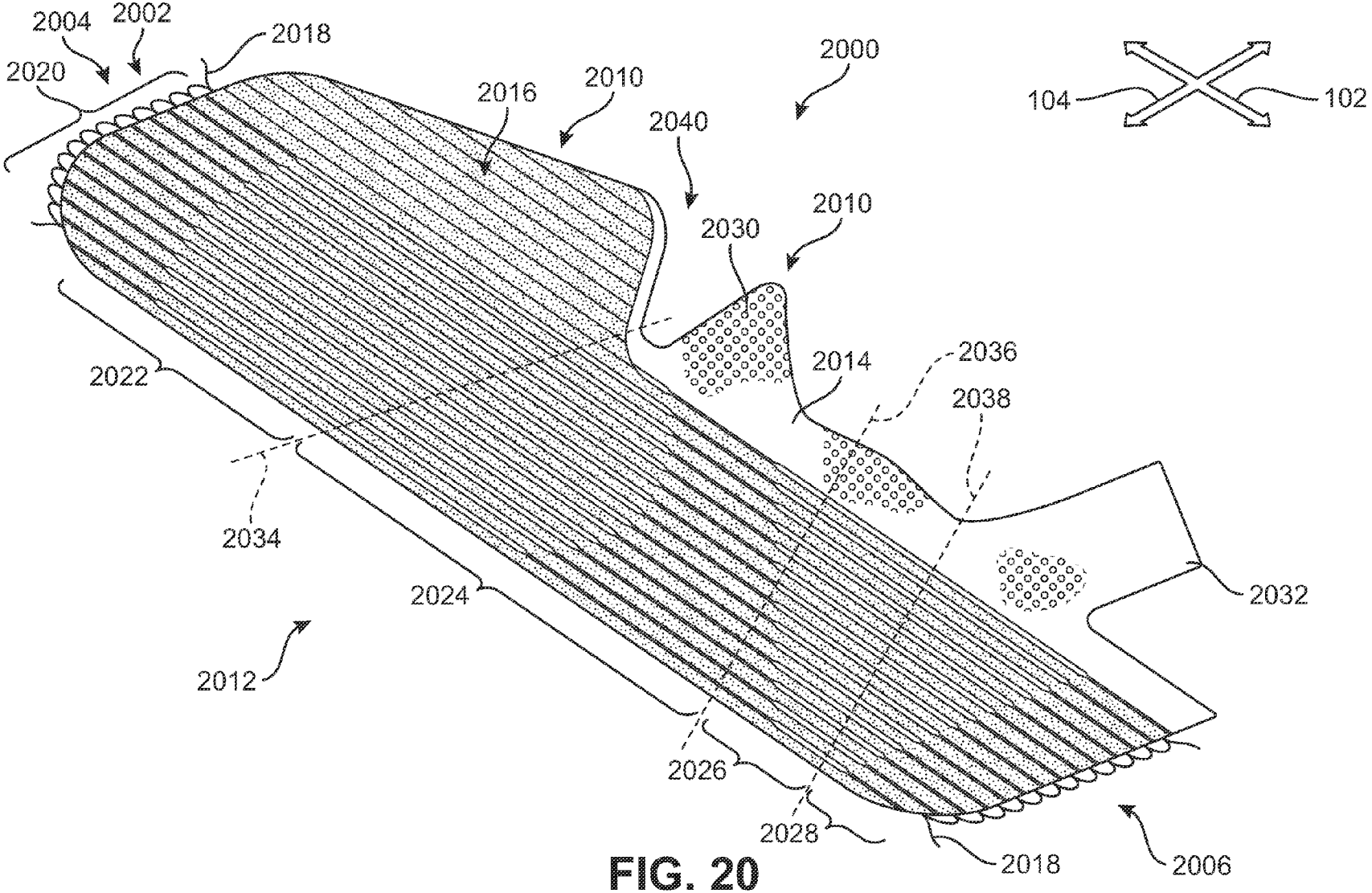
FIG. 20 is a top plan view of an embodiment of an upper for an article of footwear that includes a knitted component.

In different embodiments, a knitted component can be used to form various components or elements for an article of footwear. An embodiment of an upper 2000 for an article of footwear is illustrated in FIG. 20. Upper 2000 comprises a knitted component 2002, which can include one or more features of the knitted component of FIGS. 1-8. Upper 2000 comprises an irregular shape that is designed to allow upper 2000 to be assembled through a wrapping process, further described below. Generally, upper 2000 includes a first end 2004 and a second end 2006, representing two opposing sides along longitudinal direction 102, as well as a top edge 2010 and a bottom edge 2012. Upper 2000 additionally includes a collar portion 2014, a throat portion 2016, and a lower region 2020. Collar portion 2014 may include a first side 2030 and a second side 2032 representing generally opposing ends of collar portion 2014. Throat portion 2016 may end on one side at a throat opening 2040. Lower region 2020 includes the portion of knitted component 2002 nearer to bottom edge 2012, while throat portion 2016 includes the portion nearer to top edge 2010. Lower region 2020 generally extends from first end 2004 to second end 2006, while throat portion 2016 generally extends from first end 2004 to throat opening 2040. Thus in the embodiment of FIG. 20, ribbed features, i.e., webbed areas and tubular rib structures, disposed in lower region 2020 are of longer length in longitudinal direction 102 than ribbed features disposed in throat portion 2016. In other words, ribbed features disposed in lower region 2020 run continuously from first end 2004 to second end 2006, and ribbed features in throat portion 2016 run continuously from first end 2004 to the area along throat opening 2040.

Knitted component 2002 further comprises a first portion 2022, a second portion 2024, a third portion 2026, and a fourth portion 2028. First portion 2022 runs from first end 2004 to a first boundary 2034. Second portion 2024 runs from first boundary 2034 to a second boundary 2036. Third portion 2026 runs from second boundary 2036 to a third boundary 2038. Fourth portion 2028 runs from third boundary 2038 to second end 2006 of knitted component 2002. In some embodiments, throat portion 2016 of knitted component 2002 can include a different number of tubular rib structures and/or webbed areas than the remaining region of knitted component 2002. In some embodiments, one or more tensile elements 2018 may be included in upper 2000.

It will be understood that first boundary 2034, second boundary 2036, and third boundary 2038 are only intended for purposes of description and are not intended to demarcate precise regions of the components.

FIGS. 21-24 illustrate an embodiment of an exemplary process of assembling upper 2000 incorporating knitted component 2002 for use in an article of footwear. For reference purposes, various components associated with the article of footwear may also be associated with different regions of the foot. Components associated with an article of footwear may include an upper, a sole, a tongue, laces, toe and/or heel counters, an article forming member, or other individual elements associated with footwear. Article forming members may include, but are not limited to, a last, a mold, a foundational element, a cast, or other such devices and/or pieces.

Figure 21:
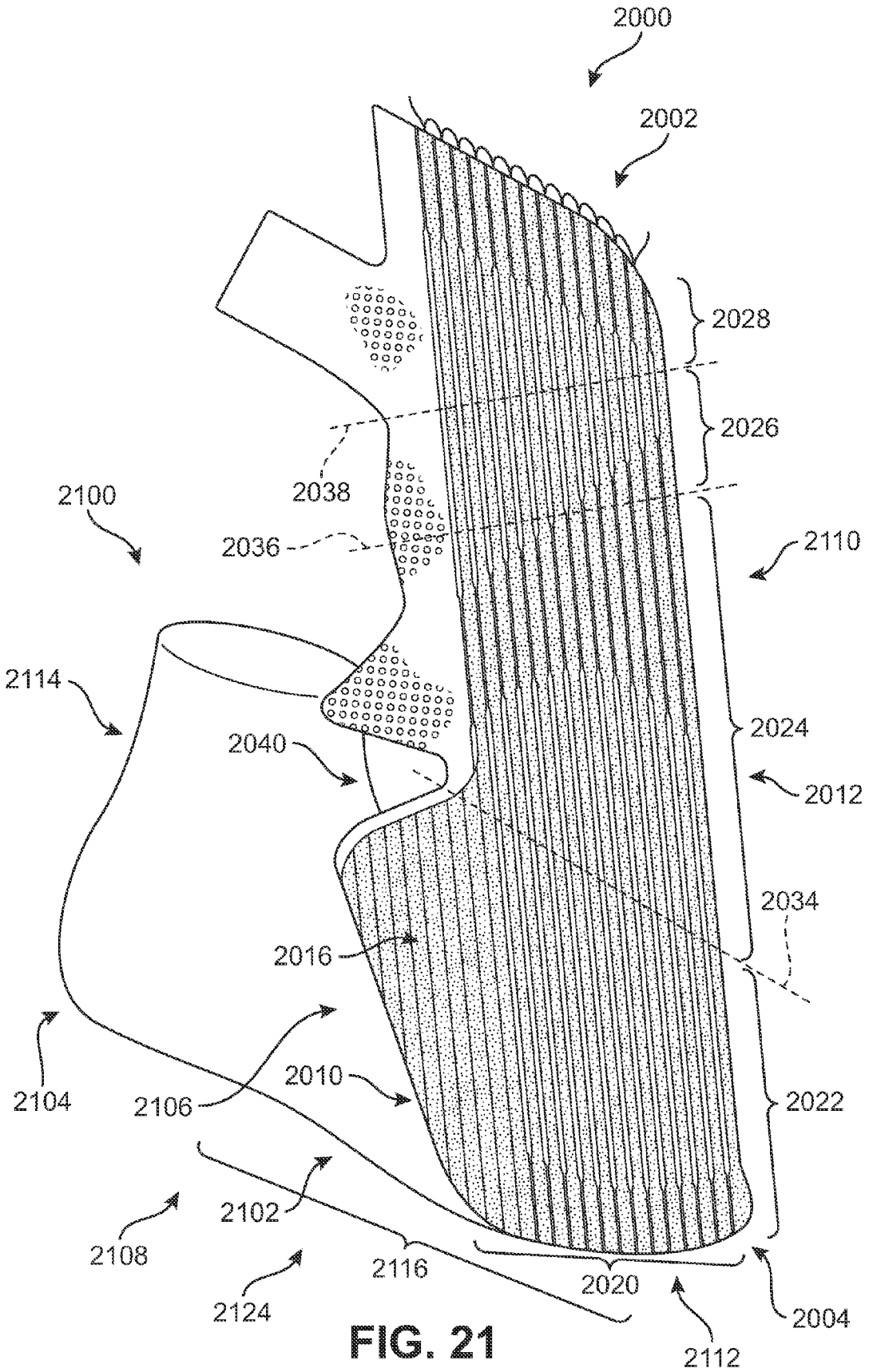
FIG. 21 is a perspective view of an upper assembly method that includes an embodiment of the knitted component.

In FIG. 21, upper 2000 is shown being associated with article forming member 2100. Article forming member 2100, as well as other components associated with footwear, may be divided into various regions that are representative of the various regions of a finished article of footwear. In the embodiment of FIGS. 21-24, article forming member 2100 is divided into six general regions: a forefoot region 2112, a midfoot region 2102, a vamp region 2106, a heel region 2104, a sole area 2124, and an ankle region 2114. Forefoot region 2112 generally includes portions of footwear corresponding with the toes and the joints connecting the metatarsals with the phalanges. Midfoot region 2102 generally includes portions of footwear or component corresponding with an arch area of a foot. Vamp region 2106 generally includes portions covering the front and top of a foot, extending from the toes to the area where the foot joins the ankle. Heel region 2104 generally corresponds with rear portions of the foot, including the calcaneus bone. Sole area 2124 generally includes the area corresponding with the sole of a foot. Sole area 2124 is typically associated with the ground-engaging surface of an article of footwear. Ankle region 2114 generally includes portions of footwear or component corresponding with an ankle and the area where the ankle joins the foot. Throat opening 2040 may be associated with ankle region 2114.

For consistency and convenience, directional adjectives are employed throughout this detailed description corresponding to the illustrated embodiments. The term forward direction ("forward") refers to a direction toward forefoot region 2112, or toward the toes when an article of footwear is worn on the foot. The term rearward direction ("rearward") refers to a direction extending toward heel region 2104, or toward the back of a foot when an article of footwear is worn on the foot. There may also be an upward direction and a downward direction, corresponding with opposite directions. The term upward direction ("upward") is the vertical direction, moving from sole area 2124 toward the upper when viewing an article of footwear. The term downward direction ("downward") refers to a direction moving from the upper toward the sole area 2124 when viewing an article of footwear.

Components associated with footwear, such as article forming member 2100, may also include a lateral side 2108 and a medial side 2110, which extend through each of forefoot region 2112, midfoot region 2102, and heel region 2104, and correspond with opposite sides of an article associated with the foot. More particularly, lateral side 2108 corresponds with an outside area of the foot (i.e., the surface that faces away from the other foot), and medial side 2110 corresponds with an inside area of the foot (i.e., the surface that faces toward the other foot). Additionally, components associated with footwear may include a forward portion 2116. Forward portion 2116 comprises the region forward of heel region 2104.

It should be noted that the terms forefoot region 2112, midfoot region 2102, vamp region 2106, heel region 2104, sole area 2124, ankle region 2114, lateral side 2108, medial side 2110, and forward portion 2116 can be applied to various individual components associated with footwear, such as an upper, a sole structure, an article of footwear, an article forming member, and/or an upper. It will be understood that forefoot region 2112, midfoot region 2102, vamp region 2106, heel region 2104, sole area 2124, ankle region 2114, and forward portion 2116 are only intended for purposes of description and are not intended to demarcate precise regions of the components. Likewise, medial side 2110 and lateral side 2108 are intended to represent generally two sides of a component, rather than precisely demarcating the component into two halves.

In some embodiments, an article forming member 2100 can be used to facilitate assembly of an article. In other embodiments, different foundational elements or solid forms may be used in the process of assembly, most commonly including a last. In FIG. 21, first end 2004 is removably attached to the underside of article forming member 2100 along forefoot region 2112 and partway along lateral side 2108 of midfoot region 2102. First portion 2022 of upper 2000 is extended across article forming member 2100 so that it fully covers vamp region 2106.

Figure 22:
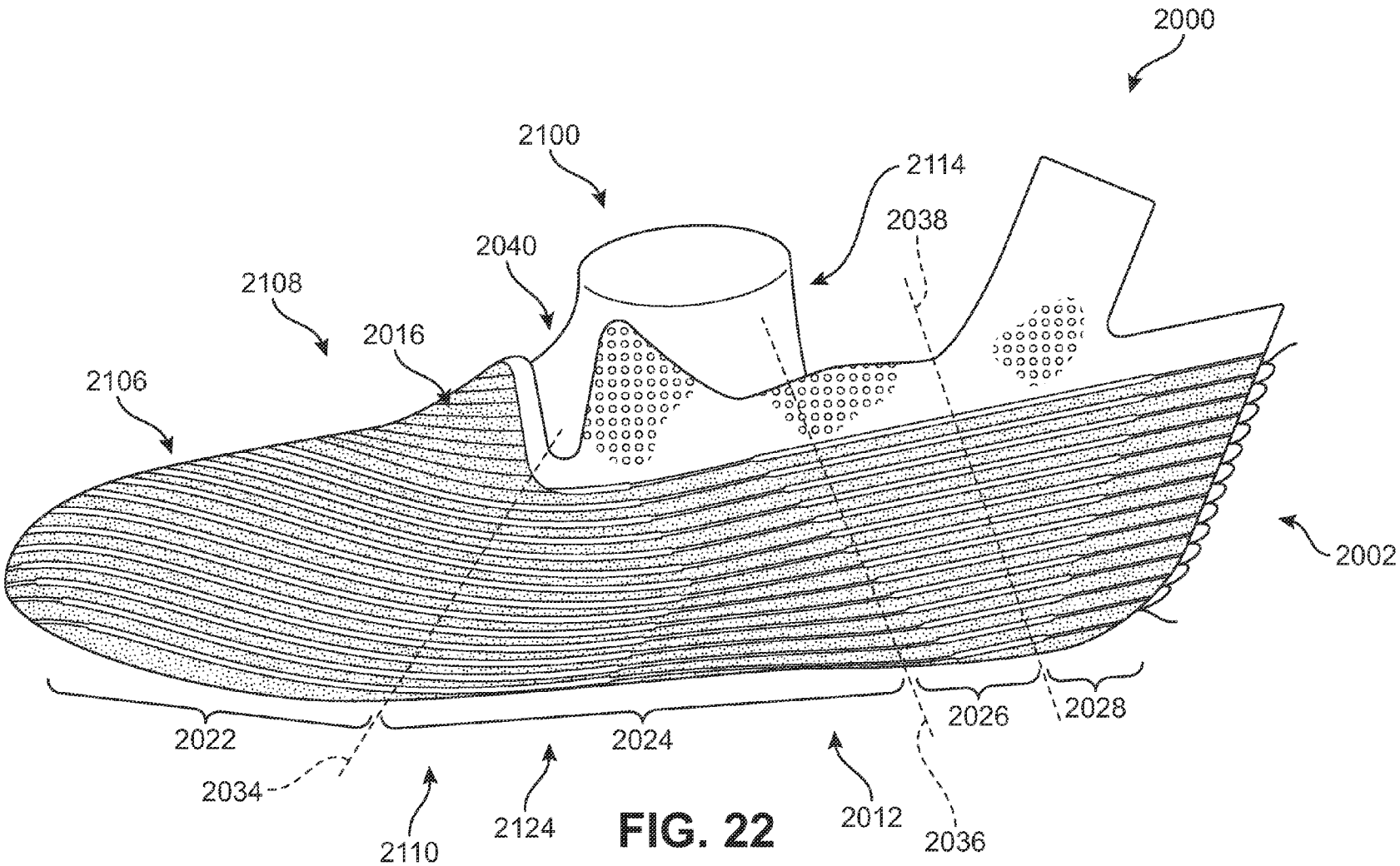
FIG. 22 is a perspective view of an upper assembly method that includes an embodiment of the knitted component.

In FIG. 22, upper 2000 is shown as it is further extended over article forming member 2100. Second portion 2024 is placed on the area corresponding to medial side 2110 of article forming member 2100. A portion of bottom edge 2012 of upper 2000 is removably attached to the underside of article forming member 2100 along medial side 2110.

Figure 23:
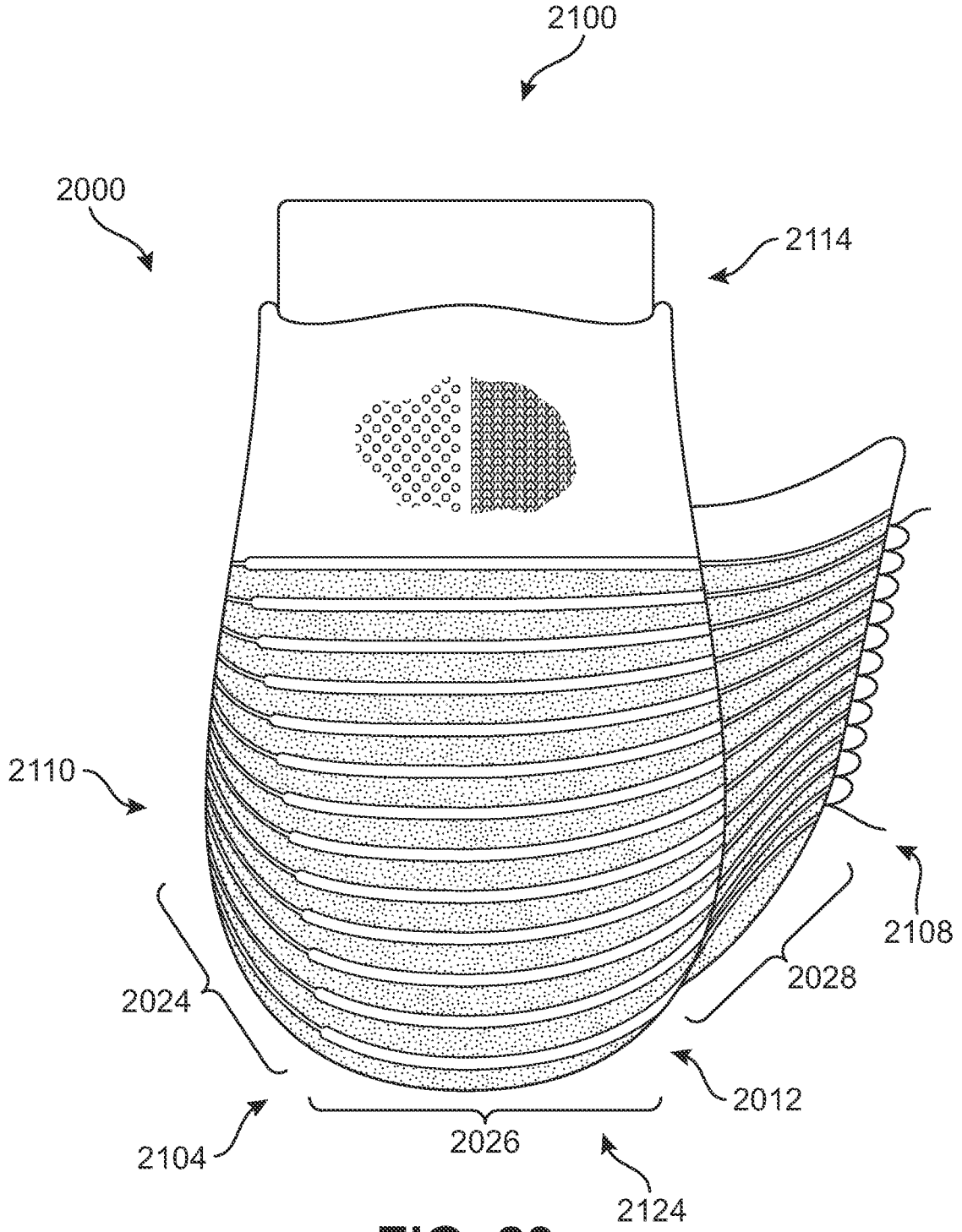
FIG. 23 is a perspective view of an upper assembly method that includes an embodiment of the knitted component.

Following this step, upper 2000 is wrapped around heel region 2104, illustrated in FIG. 23. Third portion 2026 has been placed along the area corresponding to heel region 2104 of article forming member 2100. A portion of bottom edge 2012 of upper 2000 is removably attached to the underside of article forming member 2100 along heel region 2104.

Figure 24:
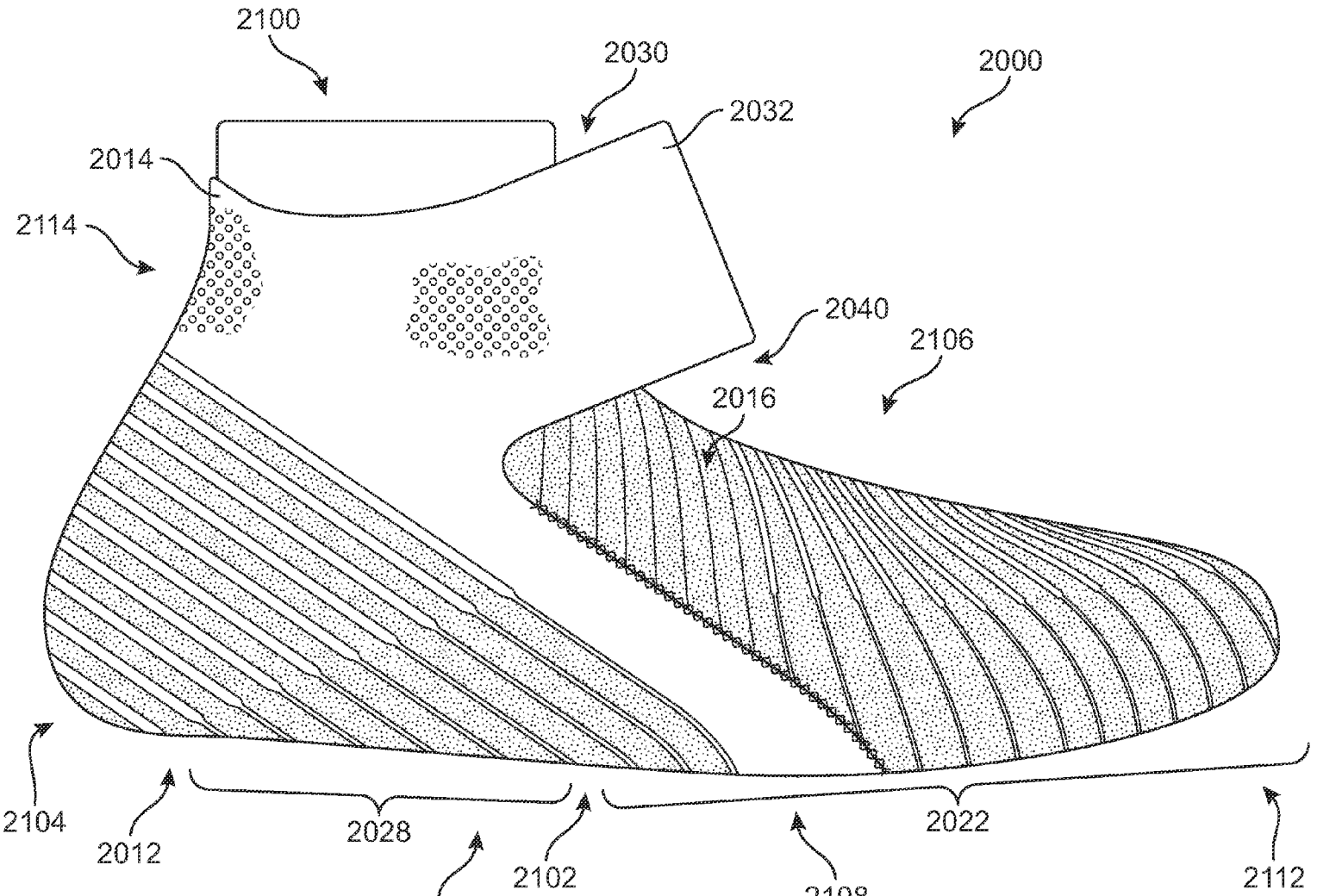
FIG. 24 is a perspective view of an upper assembly method that includes an embodiment of the knitted component.

In a next step, illustrated in FIG. 24, upper 2000 is further wrapped so that fourth portion 2028 is brought around article forming member 2100, and placed along lateral side 2108. Throat opening 2040 may be formed when fourth portion 2028 meets first portion 2022, hidden behind collar portion 2014 in FIG. 24. A portion of second side 2032 of collar portion 2014 may meet, join, or otherwise become associated with a portion of first side 2030 of collar portion 2014, covering throat opening 2040. Similarly, a portion of second end 2006 may meet, join, or otherwise become associated with a portion of first end 2004 of upper 2000. A portion of bottom edge 2012 of upper 2000 is removably attached to the underside of article forming member 2100 along lateral side 2108 of heel region 2104 and part of midfoot region 2102.

Figure 25:
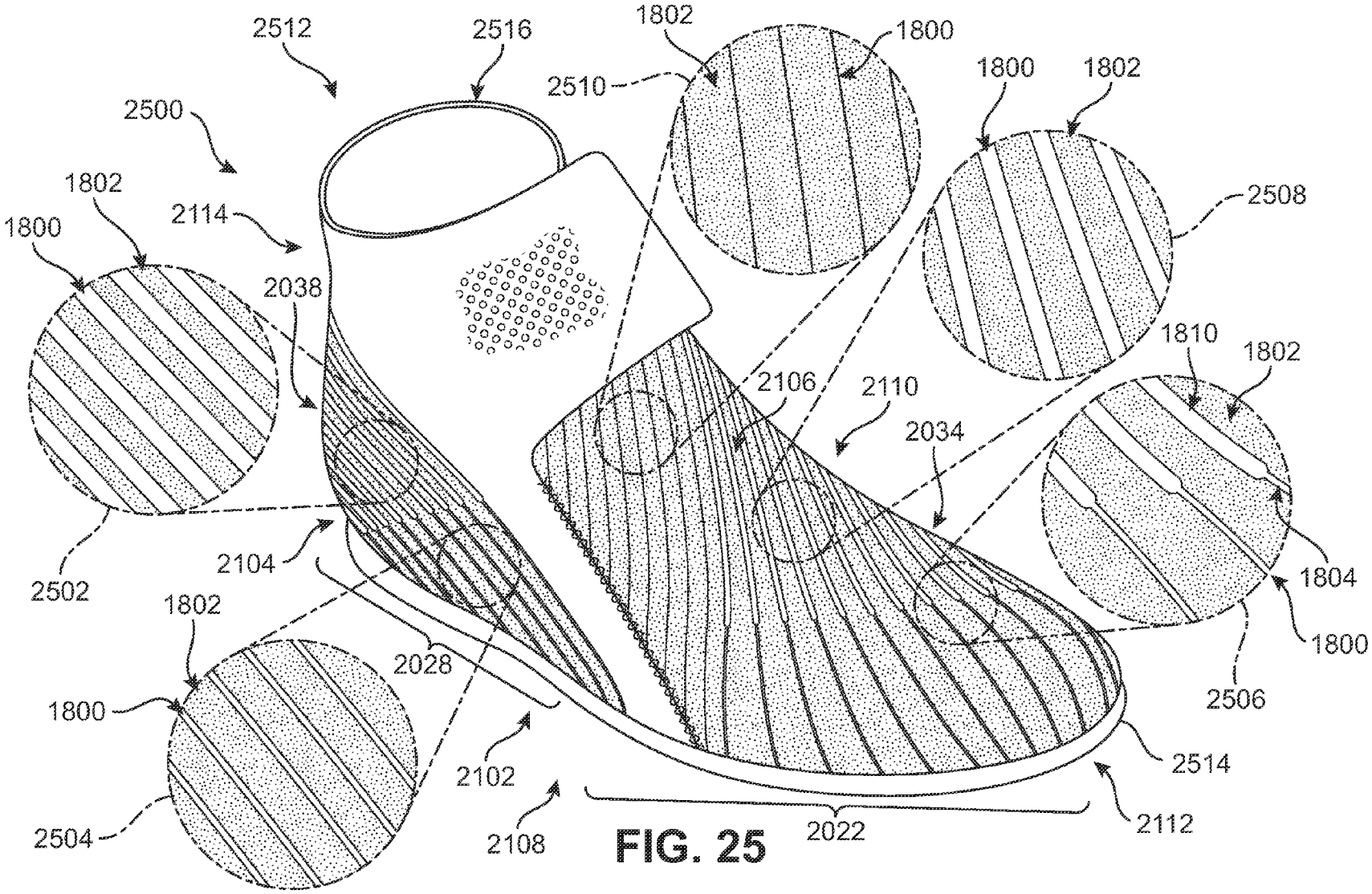
FIG. 25 is a lateral side isometric view of an article of footwear that includes an embodiment of the knitted component.
Figure 26:
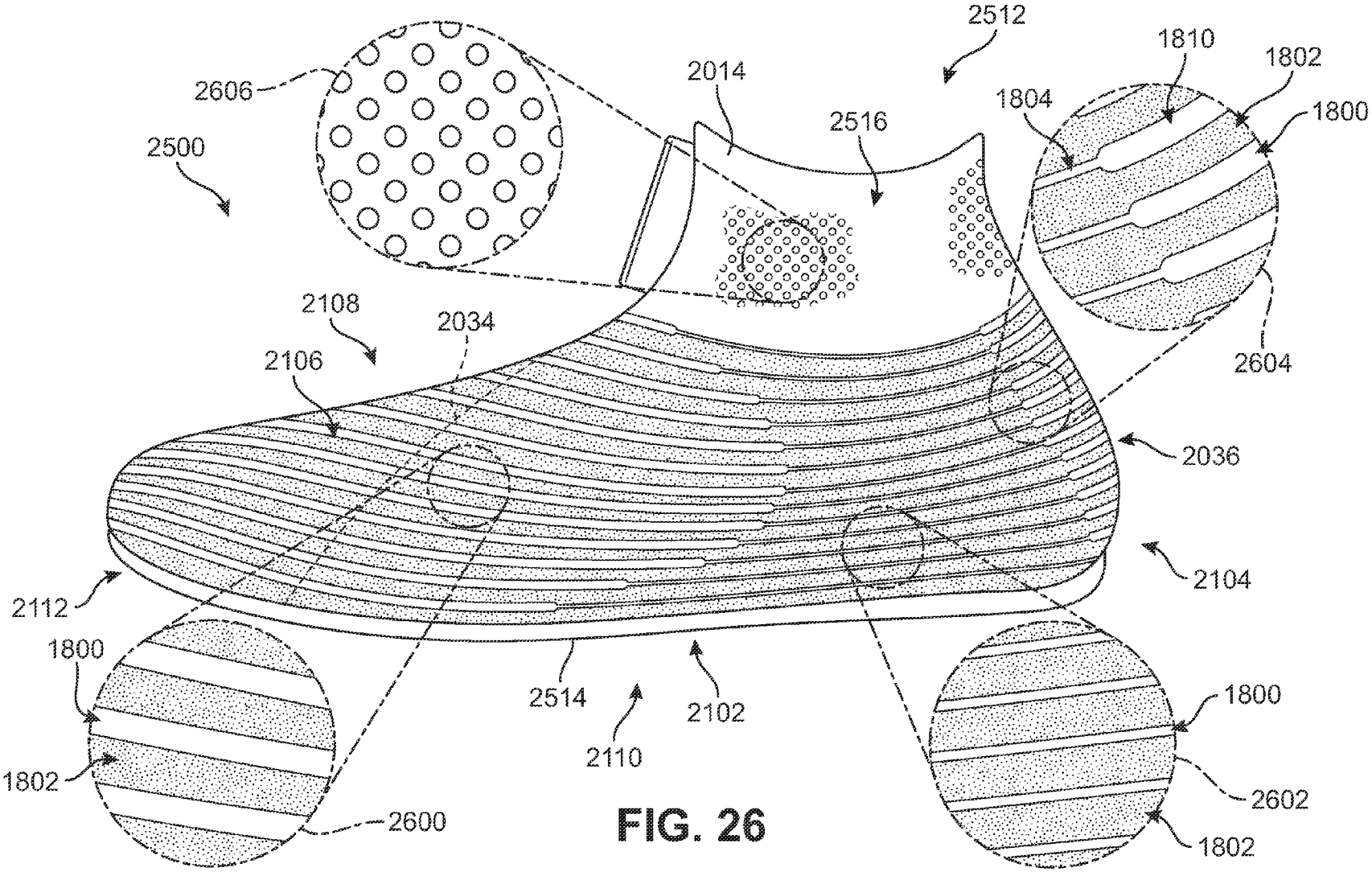
FIG. 26 is a medial side view of an article of footwear that includes an embodiment of the knitted component.
Figure 27:
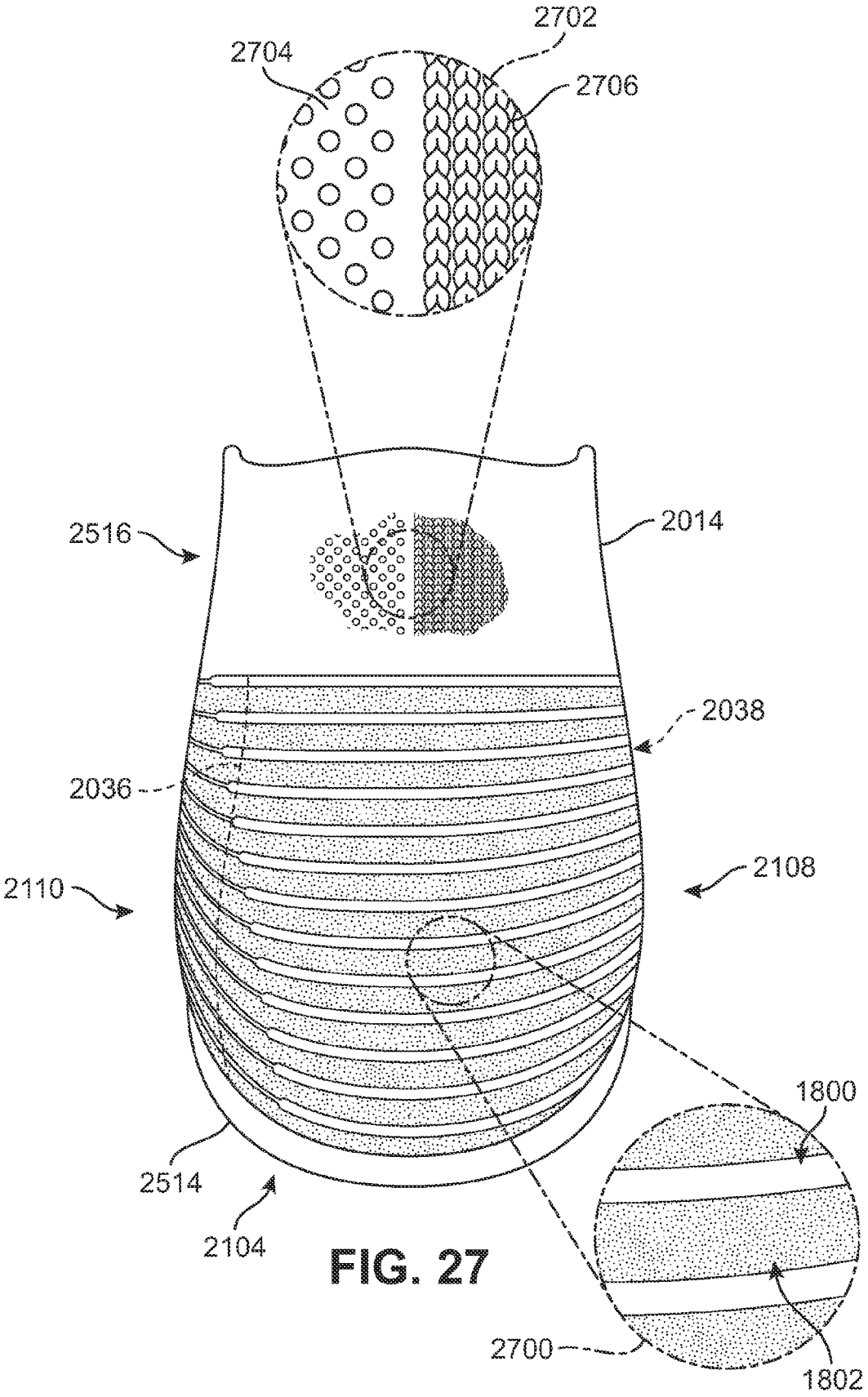
FIG. 27 is a rear view of an article of footwear that includes an embodiment of the knitted component.

FIGS. 25-27 illustrate an embodiment of an article of footwear ("footwear") 2512 that includes an assembled upper 2500 comprising knitted component 2002 of FIG. 20. In forming article of footwear 2512, a sole structure ("sole") 2514 can be secured to assembled upper 2500 along sole area 2124 and can extend between the wearer's foot and the ground when footwear 2512 is worn. Sole 2514 may differ from the embodiments of FIGS. 25-27. Sole 2514 can be a uniform, one-piece member in some embodiments. Alternatively, sole 2514 can include multiple components, such as an outsole, a midsole, and/or an insole, in some embodiments. Also, sole 2514 can include a ground-engaging surface.

Assembled upper 2500 can define a void that receives a foot of the wearer. Stated differently, assembled upper 2500 can define an interior surface that defines a void. When a wearer's foot is received within the void, assembled upper 2500 can at least partially enclose and encapsulate the wearer's foot. Assembled upper 2500 can also include a collar 2516 that may surround ankle region 2114. Collar 2516 can include an opening that is configured to allow passage of the wearer's foot during insertion or removal of the foot from the void.

An assembled upper 2500 that incorporates a knitted component may include various configurations of ribbed features, including differences in orientation, spacing, strands, size, and arrangement of webbed areas and/or tubular rib structures. In some embodiments, ribbed features can form a pattern of stripes or lines across portions of knitted component that follow a prevailing orientation. In other embodiments, the orientation of ribbed features may be in one direction across one portion of assembled upper 2500 and in another direction across a different portion of assembled upper 2500. The orientation of ribbed features along different areas of upper 2500 may be arranged in directions that help provide footwear 2512 with improved structural reinforcement and resilience in each region.

FIGS. 25-27 depict possible orientations of ribbed features along assembled upper 2500 in footwear 2512. It should be noted that in other embodiments, ribbed features can be oriented differently from the embodiments of FIGS. 25-27. In the embodiment shown in FIG. 25, five zones of assembled upper 2500 have been magnified to illustrate variations in the orientation and spacing of tubular rib structures 1802 and webbed areas 1800.

In a first zone 2502, tubular rib structures 1802 and webbed areas 1800 are oriented at an angle as they run from heel region 2104 and move downward and generally diagonally toward midfoot region 2102 along lateral side 2108 of footwear 2512. The widths of tubular rib structures 1802 and webbed areas 1800 are generally regular and generally of the same size.

In a second zone 2504, tubular rib structures 1802 and webbed areas 1800 are oriented at an angle as they run from heel region 2104 and move downward and generally diagonally toward second end 2006 along lateral side 2108. In this case, while the widths of tubular rib structures 1802 and webbed areas 1800 are generally regular, webbed areas 1800 are substantially more narrow than webbed areas of first zone 2502.

In a third zone 2506, if viewer is looking at footwear 2512 from above, tubular rib structures 1802 and webbed areas 1800 run forward and toward lateral side 2109 in a generally diagonal manner as they extend along vamp region 2106 toward forefoot region 2112. In this case, webbed areas 1800 include two different widths. Webbed areas 1800 of first width 1804 are substantially more narrow than webbed areas 1800 of second width 1810. In addition, tubular rib structures 1802 broaden in the areas adjacent to webbed areas 1800 of first width 1810. In other embodiments, tubular rib structures 1802 may remain of a substantially constant width while webbed areas 1800 include areas of varying widths. In some embodiments, tubular rib structures 1802 may change in width in some areas of assembled upper 2500 while webbed areas 1800 remain a substantially constant width in the same area.

In a fourth zone 2508, if viewer is looking at footwear 2512 from above, tubular rib structures 1802 and webbed areas 1800 run forward and toward lateral side 2109 in a generally diagonal manner as they extend along vamp region 2106, toward forefoot region 2112. In this case, while the widths of tubular rib structures 1802 and webbed areas 1800 are generally regular, webbed areas 1800 are substantially more narrow than tubular rib structures 1802. In addition, the widths of tubular rib structures 1802 in fourth zone 2508 can be seen to be less than widths of tubular rib structures 1802 in first zone 2502.

In a fifth zone 2510, if viewer is looking at footwear 2512 from above, tubular rib structures 1802 and webbed areas 1800 run forward and toward lateral side 2109 in a generally diagonal manner as they extend along vamp region 2106, toward forefoot region 2112. In this case, while the widths of tubular rib structures 1802 and webbed areas 1800 are generally regular, webbed areas 1800 are narrow to the extent that they may not be visible to viewer. In this case, webbed areas 1800 may comprise only one or two web courses. Thus, in some cases, tubular rib structures 1802 may appear to be directly adjacent to one another.

In different embodiments, the arrangements of ribbed features associated with first zone 2502, second zone 2504, third zone 2506, fourth zone 2508, and fifth zone 2510 may comprise specific orientations that can support and lend resilience to footwear 2512. For example, first zone 2502 and second zone 2504 together depict an embodiment of tubular rib structures 1802 and webbed areas 1800 that correspond to fourth portion 2028 of knitted component 2002. Therefore, when knitted component 2002 is incorporated into assembled upper 2500, the ribbed features included in fourth portion 2028 can be referred to as following along a direction associated with a "fourth orientation". The term fourth orientation, as used throughout this specification and the claims, refers to an arrangement of ribbed features where the tubular rib structures disposed along third boundary 2038 are located rearward and upward relative to the position of the tubular rib structures disposed along second end 2006 in assembled upper 2500.

Furthermore, third zone 2506, fourth zone 2508, and fifth zone 2510 together illustrate an embodiment of tubular rib structures 1802 and webbed areas 1800 that correspond to first portion 2022 of knitted component 2002. Therefore, when knitted component 2002 is incorporated into assembled upper 2500, the ribbed features included in first portion 2022 can be referred to as following along a direction associated with a "first orientation". The term first orientation, as used throughout this specification and the claims, refers to an arrangement of ribbed features where the tubular rib structures disposed along first end 2004 (hidden behind fourth portion 2028 and collar 2516 in FIGS. 25-27) are located forward and more toward lateral side 2108 relative to the position of the tubular rib structures disposed along first boundary 2034 in assembled upper 2500. Moreover, it can be seen that the first orientation of ribbed features in first portion 2022 is different from the fourth orientation of ribbed features in fourth portion 2028. Of course, other portions may be associated with still other orientations that may be similar or different from the first orientation and/or the fourth orientation.

In FIG. 26, four zones of assembled upper 2500 have been magnified to illustrate variations in the orientation and spacing of tubular rib structures and webbed areas, as well as possible differences in material. In a sixth zone 2600, tubular rib structures 1802 and webbed areas 1800 extend from forefoot region 2112 toward midfoot region 2102, oriented so that they run relatively parallel to the curve of the periphery of sole 2514 along medial side 2110 in this area. The widths of tubular rib structures 1802 and webbed areas 1800 are generally regular and of substantially the same size.

In a seventh zone 2602, tubular rib structures 1802 and webbed areas 1800 extend from midfoot region 2102 toward heel region 2104, oriented so that they run relatively parallel to the curve of the periphery of sole 2514 along medial side 2110 in this area. In this case, while the widths of tubular rib structures 1802 and webbed areas 1800 are generally regular, webbed areas 1800 are substantially more narrow than webbed areas 1800 of sixth zone 2600.

In an eighth zone 2604, tubular rib structures 1802 and webbed areas 1800 extend in the rearward direction along medial side 2110 of heel region 2104, and are oriented relatively parallel to the curve of the periphery of sole 2514 along medial side 2110 in this area. In this case, webbed areas 1800 include two different widths. Webbed areas 1800 with first width 1804 are substantially wider than webbed areas 1800 with second width 1810. In addition, tubular rib structures 1802 are broader in the areas adjacent to webbed areas 1800 with second width 1810. In other embodiments, tubular rib structures 1802 may remain at a substantially constant width while webbed areas 1800 include areas of varying widths. In some embodiments, tubular rib structures 1802 may change in width in some areas of assembled upper 2500 while webbed areas 1800 remain a substantially constant width in the same area. In other embodiments, both tubular rib structures 1802 and webbed areas 1800 may vary in width in the same area.

In different embodiments, the arrangements of ribbed features associated with sixth zone 2600, seventh zone 2602, eighth zone 2604, and ninth zone 2606 may comprise specific orientations that can support and lend resilience to footwear 2512. For example, sixth zone 2600, seventh zone 2602, and eighth zone 2604 depict an embodiment of tubular rib structures 1802 and webbed areas 1800 that correspond to second portion 2024 of knitted component 2002. Therefore, when knitted component 2002 is incorporated into assembled upper 2500, the ribbed features included in second portion 2024 can be referred to as following along a direction associated with a "second orientation". The term second orientation, as used throughout this specification and the claims, refers to an arrangement of ribbed features where the tubular rib structures disposed along first boundary 2034 are located forward relative to the position of the tubular rib structures disposed along second boundary 2036 in assembled upper 2500.

In a ninth zone 2606, one area of collar portion 2014 is magnified to depict one possible embodiment of the knit structure in this area. Collar portion 2014 may include ribbed features in some embodiments. In other embodiment, collar portion 2014 may comprise knitted material that does not include ribbed features. In one embodiment, illustrated in FIG. 26, collar portion 2014 includes a mesh region. In some embodiments, collar portion 2014 may facilitate the securing of footwear 2512 to wearer's ankle.

In FIG. 27, two zones of assembled upper 2500 have been magnified to illustrate variations in the orientation and spacing of tubular rib structures and webbed areas, as well as possible differences in material. In a tenth zone 2700, tubular rib structures 1802 and webbed areas 1800 extend from medial side 2110 toward lateral side 2108, and are oriented relatively parallel to the curve of periphery of sole 2514 along heel region 2104 in this area. In this case, the widths of tubular rib structures 1802 and webbed areas 1800 are generally regular, while webbed areas 1800 are more narrow than tubular rib structures 1802.

In an eleventh zone 2702, one area of collar portion 2014 is magnified to depict one possible embodiment of the knit structure in this area. In some embodiments, collar portion 2014 may comprise a plurality of intermeshed loops that define a variety of courses and wales. That is, knit element may have the structure of a knit textile with varying texture and construction. For example, in eleventh zone 2702, a knitted mesh portion 2704 is present in collar portion 2014, as well as a knitted solid portion 2706.

In different embodiments, the arrangement of ribbed features associated with tenth zone 2700 may comprise specific orientations that can support and lend resilience to footwear 2512. For example, tenth zone 2700 depicts an embodiment of tubular rib structures 1802 and webbed areas 1800 that correspond to third portion 2026 of knitted component 2002. Therefore, when knitted component 2002 is incorporated into assembled upper 2500, the ribbed features included in third portion 2026 can be referred to as following along a direction associated with a "third orientation". The term third orientation, as used throughout this specification and the claims, refers to an arrangement of ribbed features where the tubular rib structures disposed along second boundary 2036 are located more toward medial side 2110 relative to the position of the tubular rib structures disposed along third boundary 2038 in assembled upper 2500, and where the tubular rib structures are substantially parallel to periphery of sole 2514 along heel region 2104.

The varying orientation of ribbed features in different regions of article of footwear 2512 can provide a wearer with increased support, stability, control, and durability. The arrangements of tubular rib structures and webbed areas can promote better performance, agility, and flexibility. Specifically, as a portion of the ribbed features flow over vamp region 2106, from the periphery of sole 2514 on lateral side 2108 and extending toward medial side 2110, wearer may have additional support, structural reinforcement, and cushioning as the foot moves from side to side. Lateral support is increased as the ribbed features resist deformation along lateral side 2108, allowing a wearer to perform better as he/she engages in various plays, such as a lateral cutting movement. The particular orientation of ribbed features may also provide better pronation control of the foot. This is due in part to the fact that knitted component 2002 included in assembled upper 2500 has a capacity for greater stretch along lateral direction 104 than along longitudinal direction 102, as discussed earlier.

In addition, in embodiments where the knitted component includes one or more tensile elements disposed through the tubular rib structures, for example, tensile elements 2018 of knitted component 2002, the tensile elements further provide support and resistance to stretching following along the direction of the tensile element as it is disposed through the orientation of the tubular rib structure. With this arrangement, portions of knitted component 2002 that include tensile elements 2018 may be configured to provide additional lateral support along lateral side 2108, allowing a wearer to perform better as he/she engages in various plays, such as a lateral cutting movement. Additionally, in some embodiments, the selective inclusion or absence of tensile elements 2018 in specific tubular rib structures of knitted component 2002 may allow for some degree of stretch or deformation in desired portions of the finished article of footwear.

Heel region 2104 is supported in a similar fashion, where the ribbed features are oriented parallel to the periphery of sole 2514. As a result there is greater stability and control for a wearer during movements of the heel, because the capacity for stretch in longitudinal direction 102 in that region is limited relative to stretch in lateral direction 104. Wearer may also be provided with a higher degree of agility. For example, the ribbed features disposed in area of assembled upper 2500 associated with the bending of the foot in the arch and ball areas are oriented in such a way as to provide greater flexibility, so that wearer can experience better responsiveness and comfort during bending movements. Overall the structural strengthening available with assembled upper 2500 may help provide both increased support and control, as well as greater stability during flexing.

It should be understood that the embodiments in FIGS. 25-27 are for illustrative purposes only and depict only one embodiment of an upper including a knitted component. In other embodiments, the shape, length, thickness, width, arrangement, orientation, and density of ribbed features of assembled upper 2500 may vary.

Other articles can include knitted component 100 as well. For example, knitted component 100 can be included in a strap or other part of an article of apparel. In other embodiments, knitted component(s) 100 can be further included in a strap for a bag or other container. In some embodiments, container article can include one or more features that are similar to a duffel bag. In other embodiments, container article can include features similar to a backpack or other container. Ribbed features can resiliently deform to allow a strap to lengthen under a load from container body. Ribbed features can attenuate cyclical loading in some embodiments. Also, ribbed features can deform under compression, for example, to allow strap to conform to the user's body and/or to provide cushioning. Additional embodiments may include incorporation of knitted component 100 into an article of apparel. It will be appreciated that the article of apparel can be of any suitable type, including a sports bra, a shirt, a headband, a sock, or other articles. Use of articles of apparel incorporating knitted component 100 may allow wearer to experience improvement in balance, comfort, grip, support, and other features.

It will further be appreciated that knitted components of the types discussed herein can be incorporated into other articles as well. For example, knitted component 100 can be included in a hat, cap, or helmet in some embodiments. In some embodiments, knitted component 100 can be a liner for the hat, cap, or helmet. Thus, the resiliency of knitted component 100 can allow the hat, cap, or helmet that helps conform article to the wearer's head. Knitted component 100 can also provide cushioning for the wearer's head.

In summary, the knitted component of the present disclosure can be resilient and can deform under various types of loads. This resilience can provide cushioning, for example, to make the article more comfortable to wear. This resilience can also allow the article to stretch and recover back to an original width. Accordingly, in some embodiments, knitted component can allow the article to conform to the wearer's body and/or to attenuate loads. Furthermore, the knitted component can be efficiently manufactured and assembled.

While various embodiments of the present disclosure have been described, the description is intended to be exemplary, rather than limiting, and it will be apparent to those of ordinary skill in the art that many more embodiments and implementations are possible that are within the scope of the present disclosure. Accordingly, the present disclosure is not to be restricted except in light of the attached claims and their equivalents. Also, various modifications and changes may be made within the scope of the attached claims.

What is claimed is:

1. An article comprising:

a plurality of webbed areas that include a plurality of courses formed from a first yarn, the webbed areas having a front surface, the webbed areas configured to move between a neutral position and an extended position, the webbed areas being biased to move toward the neutral position and a plurality of tubular structures that are adjacent to the webbed areas, the tubular structures including a plurality of courses;

wherein at least one of the webbed areas or tubular structures is configured to stretch to move the webbed areas to the extended position in response to a force applied to the article wherein in the neutral position, a first area of the front surface is hidden from visual observation from a first viewing perspective, and wherein in the extended position, the first area of the front surface is revealed for visual observation from the first viewing perspective.

2. The article of claim 1, wherein the article is associated with a longitudinal direction and a lateral direction;

wherein the plurality of webbed areas and the plurality of tubular structures extend along the longitudinal direction, wherein the plurality of webbed areas and the plurality of tubular structures are spaced apart in the lateral direction, and wherein the article is configured to stretch in the lateral direction between the neutral position and the stretched position, the article biased toward the neutral position.

3. The article of claim 2, wherein the plurality of webbed areas and the plurality of tubular structures are disposed in an alternating manner across the majority of the article.

4. The article of claim 1, wherein the article further comprises a first portion and a second portion, wherein the first portion and the second portion include at least one webbed area in common, and wherein the number of courses forming the at least one webbed area of the first portion is less than the number of courses forming the at least one webbed area of the second portion.

5. The article of claim 1, wherein at least one tubular structure of the plurality of tubular structures includes a tensile element disposed in a central unsecured area within the hollow between the two knit layers.

6. The article of claim 1, further comprising:

the plurality of webbed areas including at least a first webbed area and a second webbed area;

the plurality of tubular structures including at least a first tubular structure and a second tubular structure;

wherein the first tubular structure includes a first curved portion and a second curved portion, wherein the first curved portion and the second curved portion are joined along a first edge, and the first curved portion and the second curved portion are joined along a second edge;

wherein the first webbed area is adjacent to the first edge of the first tubular structure;

wherein the second webbed area is adjacent to the second edge of the first tubular structure;

wherein the second tubular structure includes a third curved portion and a fourth curved portion, wherein the third curved portion and the fourth curved portion are joined along a third edge, and the third curved portion and the fourth curved portion are joined along a fourth edge; and wherein the second webbed area is adjacent to the third edge of the second tubular structure.

7. The article of claim 1, wherein the plurality of webbed areas include one of a front jersey knit pattern and a reverse jersey knit pattern.

8. An upper comprising:

a plurality of webbed areas and a plurality of tubular rib structures;

the plurality of webbed areas having a front side and a back side;

the tubular rib structures being disposed adjacent to the webbed areas;

the tubular rib structures having a first curved portion with a first curve length extending from the front side of the webbed areas, and a second curved portion with a second curve length extending from the back side of the webbed areas, the first curve length being greater than the second curve length;

the webbed areas configured to move between a neutral position and an extended position, the webbed areas being biased to move toward the neutral position; and at least one of the webbed areas and the tubular rib structures configured to stretch from the neutral position to the extended position in response to a force applied to the upper.

9. The upper of claim 8, wherein the webbed areas include a plurality of courses formed from a first yarn, wherein the tubular rib structures include a plurality of courses formed from a second yarn, wherein the first yarn and the second yarn are different; and wherein at least one course of one of the plurality of webbed areas formed with the first yarn is connected with at least one course of one of the plurality of tubular rib structures formed with the second yarn.

10. The upper of claim 8, wherein the upper further includes a vamp region and a medial side, wherein the plurality of webbed areas and the plurality of tubular rib structures disposed along the vamp region are aligned along a first orientation, and the plurality of webbed areas and the plurality of tubular rib structures disposed along the medial side are aligned along a second orientation that is different from the first orientation.

11. The upper of claim 10, wherein the upper further includes a heel region, and the plurality of webbed areas and the plurality of tubular rib structures disposed along the heel region are aligned along a third orientation that is different from the first orientation and the second orientation.

12. The upper of claim 8, wherein the upper further includes a throat portion, a throat opening, a lower region, a first end, and a second end;

wherein the plurality of webbed areas and the plurality of tubular rib structures of the lower region extend from the first end of the upper to the second end of the upper; and wherein the plurality of webbed areas and the plurality of tubular rib structures of the collar portion extend from the first end of the upper to the area along the throat opening of the upper.

13. The upper of claim 12, further comprising a tensile element disposed within at least one of the plurality of tubular rib structures.

14. The upper of claim 8, wherein the plurality of webbed areas comprises a first webbed area and a second webbed area;

wherein the first webbed area has a first width, and the second webbed area has a second width, the first width being less than the second width.

15. The upper of claim 8, wherein the plurality of webbed areas and the plurality of tubular rib structures are disposed in an alternating manner across the majority of the upper.

16. The article of claim 1, wherein the plurality of tubular structures comprise (i) two co-extensive and overlapping knit layers and (ii) a central area that is generally unsecured to form a hollow between two knit layers.

17. The article of claim 1, wherein the article includes a knitted component, the knitted component comprising the plurality of webbed areas and the plurality of tubular structures.

18. The article of claim 17, wherein the knitted component is formed of unitary knit construction.

19. The upper of claim 8, wherein the upper includes a knitted component, the knitted component comprising the plurality of webbed areas and the plurality of tubular rib structures.

20. An article comprising:

a plurality of webbed areas having a front surface, the webbed areas configured to move between a neutral position and an extended position, the webbed areas being biased to move toward the neutral position, and a plurality of tubular structures that are adjacent to the webbed areas, the tubular structures;

wherein at least one of the webbed areas or tubular structures is configured to stretch to move the webbed areas to the extended position in response to a force applied to the article.

wherein in the neutral position, a first area of the front surface is hidden from visual observation from a first viewing perspective, and wherein in the extended position, the first area of the front surface is revealed for visual observation from the first viewing perspective.

* * * * *